US005549092A

United States Patent [19]

Hasegawa et al.

[11] Patent Number: 5,549,092

[45] Date of Patent: Aug. 27, 1996

[54] FUEL METERING CONTROL SYSTEM IN INTERNAL COMBUSTION ENGINE

[75] Inventors: Yusuke Hasegawa; Isao Komoriya; Shusuke Akazaki; Hidetaka Maki; Satoru Abe, all of Wako, Japan

[73] Assignee: Honda Giken Kogyo Kabushiki Kaisha, Tokyo, Japan

[21] Appl. No.: 507,974

[22] Filed: Jul. 27, 1995

[30] Foreign Application Priority Data

Jul. 29, 1994 [JP] Japan ..... 6-197237

[51] Int. Cl.[6] ..... F02D 41/10; F02D 41/18

[52] U.S. Cl. ..... 123/478; 123/492

[58] Field of Search ..... 123/478, 480, 123/486, 492, 493, 494

[56] References Cited

U.S. PATENT DOCUMENTS

| | | | |
|---|---|---|---|
| 4,446,523 | 5/1984 | Reinke | 364/431.05 |
| 4,805,579 | 2/1989 | Toshimitsu et al. | 123/492 |
| 4,823,755 | 4/1989 | Hirose et al. | 123/486 |
| 4,907,556 | 3/1990 | Ishii et al. | 123/486 |
| 4,949,694 | 8/1990 | Nagaishi et al. | 123/486 |
| 4,967,715 | 11/1990 | Hosaka | 123/478 |
| 4,996,960 | 3/1991 | Nishiyama et al. | 123/492 |
| 5,035,225 | 7/1991 | Mizukoshi | 123/492 |
| 5,134,981 | 8/1992 | Takahashi et al. | 123/492 |
| 5,349,933 | 9/1994 | Hasegawa et al. | 123/480 |
| 5,427,072 | 6/1995 | Udo | 123/492 |
| 5,448,978 | 9/1995 | Hasegawa et al. | 123/486 |

FOREIGN PATENT DOCUMENTS 2-157451 6/1990 Japan .

*Primary Examiner*—Willis R. Wolfe, Jr.
*Attorney, Agent, or Firm*—Nikaido, Marmelstein, Murray & Oram LLP

[57] ABSTRACT

A system for controlling fuel metering in an internal combustion engine using a fluid dynamic model and the quantity of throttle-past air is determined therefrom. Based on the observation that the difference between the steady-state engine operating condition and the transient engine operating condition can be described as the difference in the effective throttle opening areas, the quantity of fuel injection is determined from the product of the ratio between the area and its first-order lag value and the quantity of fuel injection under the steady-state engine operating condition obtained by mapped data retrieval, and by subtracting the quantity of correction corresponding to the quantity of chamber-filling air. The effective throttle opening area's first order lag is calculated using a weight that varies with the engine speed, so that elongation or shortening of the TDC interval due to the decrease/increase of the engine speed will not affect the determination of the quantity of fuel injection.

14 Claims, 21 Drawing Sheets

FIG. 9

| | Pb |
|---|---|
| Ne | Desired A/F |

FUEL METERING CONTROL SYSTEM IN INTERNAL COMBUSTION ENGINE

BACKGROUND OF THE INVENTION

1. Field of the Invention

This invention relates to a system for controlling fuel metering in an internal combustion engine, more particularly to a system for controlling fuel metering in an internal combustion engine wherein the quantity of fuel injection is optimally determined over the entire range of engine operating conditions including transient engine operating condition using an intake air model and by simplifying its calculation.

2. Description of the Prior Art

In a conventional fuel metering control system, the quantity of fuel injection was usually determined by retrieving mapped data predetermined through experimentation and stored in advance in a microcomputer memory using parameters having intrinsically high degrees of correlation with the quantity of air drawn in the engine cylinder. As a result, the conventional technique was utterly powerless to cope with any change in the parameters which had not been taken into account at the time of preparing the mapped data. Further, since the mapped data were intrinsically prepared solely focussing on the steady-state engine operating condition and the transient engine operating condition was not accounted for, the conventional technique was unable to determine the quantity of fuel injection under the transient engine operating condition with accuracy. For that reason, there are recently proposed techniques to establish a fluid dynamic model describing the behavior of the air intake system so as to accurately estimate the quantity of air drawn in the cylinder such as disclosed in Japanese Laid-Open Patent Application 2(1990)-157,451 or U.S. Pat. No. 4,446,523.

Similarly the assignee proposed in Japanese Patent Application 4(1992)-200,330 (filed in the United States on Jul. 2, 1993 under the number of 08/085,157) a method for estimating the quantity of air drawn in the cylinder by determining the quantity of throttle-past air while treating the throttle (valve) as an orifice to establish a fluid dynamic model based on the standard orifice equation for compressible fluid flow. The fluid dynamic model used was, however, premised on an ideal state and required various assumptions. It was therefore impossible to wipe out all the errors which could be introduced at the time of modeling. Further, since it was quite difficult to accurately determine constants such as the specific-heat ratio used in the model, errors possibly arising therefrom could disadvantageously be accumulated. Furthermore, the equation necessitated calculation of powers, roots or the like. Since approximate values were used for them in practice, additional errors resulted.

The assignee therefore proposed in Japanese Patent Applications 4(1992)-306,086 and in the additional application claiming the domestic priority thereof (5(1993)-186,850)(both filed in the United States on Oct. 18, 1993 under the number of 08/137,344 and patented under the number of U.S. Pat. No. 5,349,933) a system for controlling fuel metering in an internal combustion engine which, although it was based on a fluid dynamic model, could absorb errors in the model equations and optimally determine the quantity of fuel injection over the entire range of engine operating conditions including the transient engine operating condition without conducting complicated calculations. In addition, the assignee proposed an improvement of the technique in Japanese Patent Application 5(1993)-208,835 (filed in the United States and patented as above). Specifically, as illustrated in FIG. 10, a large quantity of air passes through the throttle valve at a time when it was opened, since the pressure difference across the throttle plate was large at the transient engine operating condition. In the improved technique, therefore, the assignee proposed to describe the quantity of throttle-past air at the transient engine operating condition by calculating a ratio (referred to as "RATIO-A") between the effective throttle opening area A and its first-order lag value ADELAY, so as to absorb errors in model equations and optimally determine the quantity of fuel injection irrespective of the operating condition of the engine or presence/absence of aging of the engine.

However, as illustrated in FIG. 22, the TDC interval, i.e., the control or program (calculation) interval (cycle) varies with the engine speed. The interval (cycle) at a low engine speed (shown as "INT-L" in the figure) becomes longer than that at a high engine speed (shown as "INT-H" in the figure). As a result, as will be apparent from FIG. 23A, the ratio (RATIO-A=A/ADELAY) becomes excessively large at a low engine speed so that the ratio is not always appropriate for describing the quantity of throttle-past air at the transient engine operating condition illustrated in FIG. 23B (which is similar to that shown at the bottom of FIG. 10).

SUMMARY OF THE INVENTION

An object of the invention is therefore to improve the assignee's earlier proposed techniques and to provide a system for controlling fuel metering in an internal combustion engine which can accurately describe the quantity of throttle-past air irrespective of the change in the TDC interval due to the increase/decrease of the engine speed, ensuring optimal determination of the quantity of fuel injection over the entire range of engine operating conditions including the transient engine operating condition.

For realizing the objects, the present invention provides a system for controlling fuel metering in an internal combustion engine, including engine operating condition detecting means for detecting parameters indicating an engine operating condition at least including an engine speed (Ne), a manifold pressure (Pb) and a throttle valve opening (θTH), fuel injection quantity obtaining means for obtaining a quantity of fuel injection (Timap) in accordance with a predetermined characteristic at least based on the engine speed (Ne) and the manifold pressure (Pb); first effective throttle opening area determining means for determining an effective throttle opening area (A) at least based on the throttle valve opening (θTH) and the manifold pressure (Pb), second effective throttle opening area determining means for determining a value (ADELAY) indicative of an n-th order lag of the effective throttle opening area (A), and fuel injection quantity determining means for determining a quantity of fuel injection (Tout) by multiplying the quantity of fuel injection (Timap) by a ratio between the effective throttle opening area (A) and the value (ADELAY) as $$Tout=Timap\times A/ADELAY.$$

In the system, it is arranged such that said second effective throttle opening area determining means determines the value (ADELAY) using a time constant that varies with the engine speed (Ne).

BRIEF DESCRIPTION OF THE DRAWINGS

These and other objects and advantages of the invention will be more apparent from the following description and drawings, in which:

FIG. 9 is a view explaining a characteristic of mapped data of a desired air/fuel ratio used in the calculation of the system;

DETAILED DESCRIPTION OF THE PREFERRED EMBODIMENTS

The embodiments of the invention will now be explained with reference to the drawings.

Figure 1:
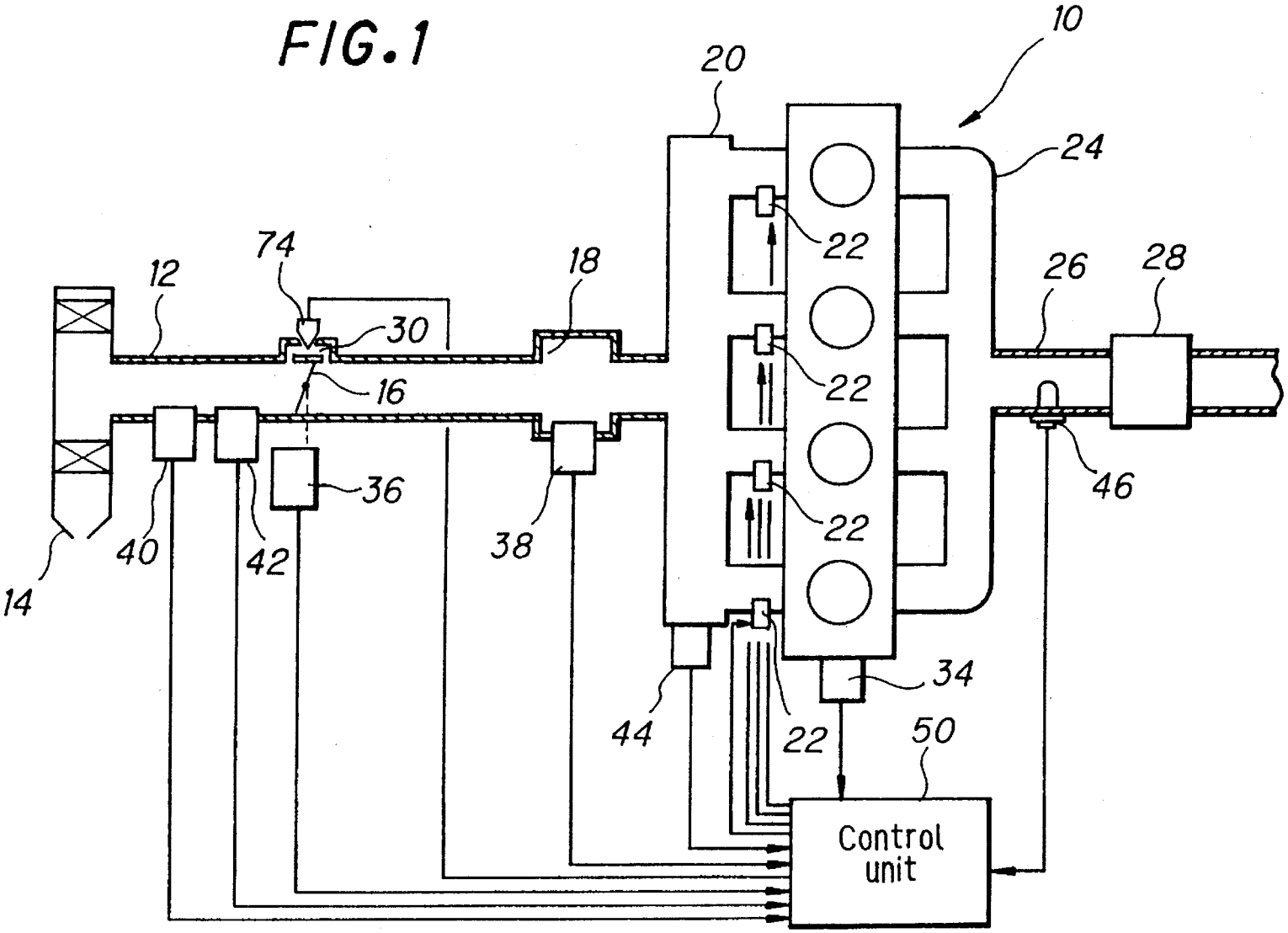
FIG. 1 is an overall block diagram showing a fuel metering control system according to the invention.

An overall view of the fuel metering control system according to the invention is shown in FIG. 1. Reference numeral 10 in this figure designates a four cylinder internal combustion engine. Air drawn in an air intake pipe 12 through an air cleaner 14 mounted on its far end is supplied to first to fourth cylinders through a surge tank (chamber) 18 and an intake manifold 20 while the flow thereof is adjusted by a throttle valve (plate) 16. A fuel injector 22 for injecting fuel is installed in the vicinity of the intake valve (not shown) of each cylinder. The injected fuel mixes with the intake air to form an air-fuel mixture that is introduced and ignited in the associated cylinder by a spark plug (not shown). The resulting combustion of the air-fuel mixture drives down a piston (not shown). The exhaust gas produced by the combustion is discharged through an exhaust valve (not shown) into an exhaust manifold 24, from where it passes through an exhaust pipe 26 to a three-way catalytic converter 28 where it is cleared of noxious components before being discharged to atmosphere. The air intake pipe 12 is provided with a secondary path 30 which bypasses the throttle valve 16.

A crank angle sensor 34 for detecting the piston crank angles is provided in a distributor (not shown) of the internal combustion engine 10, a throttle position sensor 36 is provided for detecting the degree of opening $\theta$TH of the throttle valve 16, and a manifold absolute pressure sensor 38 is provided for detecting the absolute pressure Pb of the intake air downstream of the throttle valve 16. On the upstream side of the throttle valve 16, there are provided an atmospheric pressure sensor 40 for detecting the atmospheric (barometric) pressure Pa, and an intake air temperature sensor 42 for detecting the temperature of the intake air Ta. And a second temperature sensor 44 is provided for detecting the engine coolant water temperature Tw. In addition, an air/fuel ratio sensor 46 comprising an oxygen concentration detector is provided in the exhaust system at a point downstream of the exhaust manifold 24 and upstream of the three-way catalytic converter 28, where it detects the air/fuel ratio of the exhaust gas. The outputs of the sensor 34, etc., are sent to a control unit 50.

Figure 2:
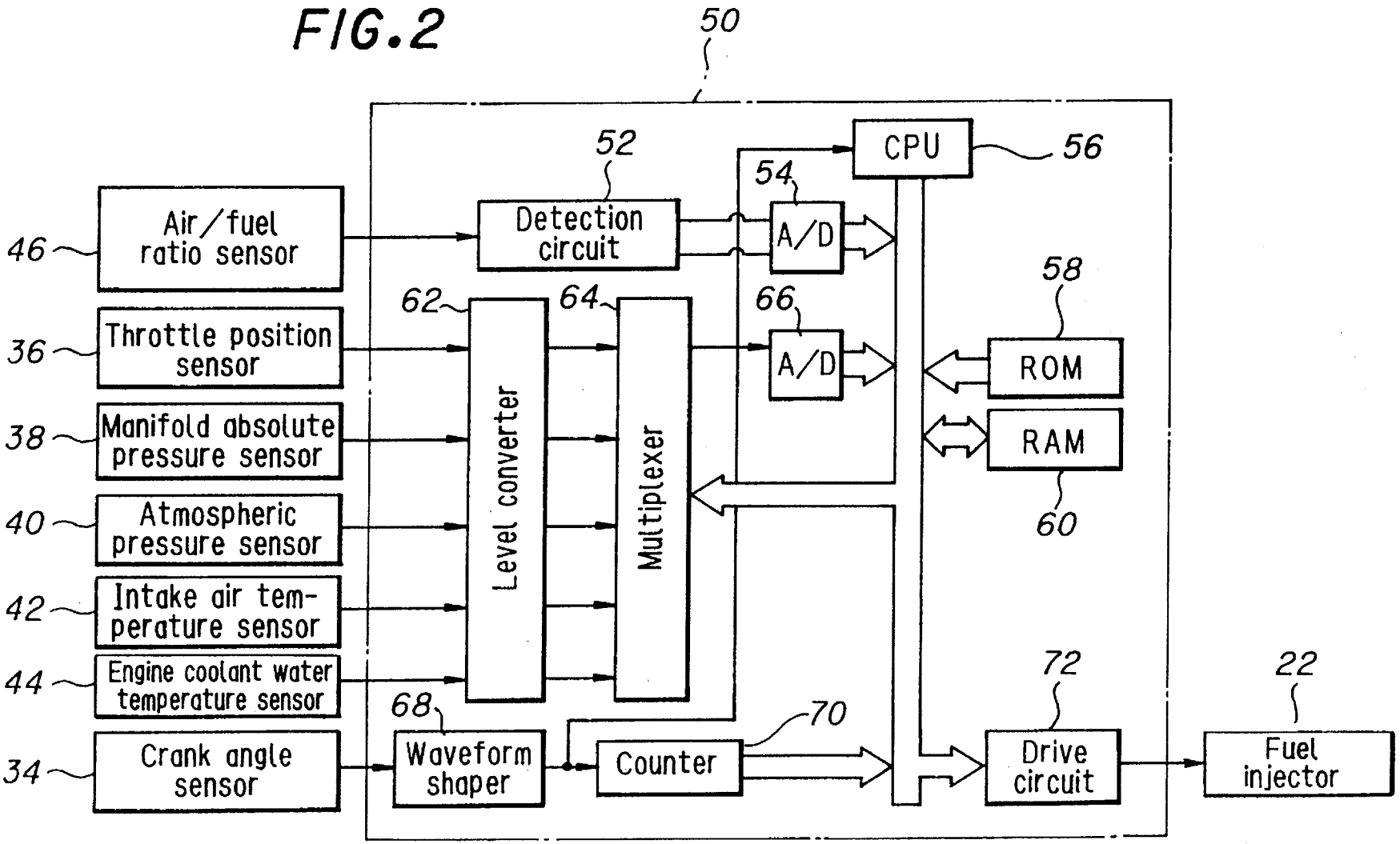
FIG. 2 is a block diagram showing the details of the control unit illustrated in FIG. 1.

Details of the control unit 50 are shown in the block diagram of FIG. 2. The output of the air/fuel ratio sensor 46 is received by a detection circuit 52 of the control unit 50, where it is subjected to appropriate linearization processing to obtain an air/fuel ratio characterized in that it varies linearly with the oxygen concentration of the exhaust gas over a broad range extending from the lean side to the rich side. The output of the detection circuit 52 is forwarded through an A/D (analog/digital) converter 54 to a microcomputer comprising a CPU(central processing unit) 56, a ROM (read-only memory) 58 and a RAM (random access memory) 60 and is stored in the RAM 60. Similarly, the analog outputs of the throttle position sensor 36, etc., are input to the microcomputer through a level converter 62, a multiplexer 64 and a second A/D converter 66, while the output of the crank angle sensor 34 is shaped by a waveform shaper 68 and has its output value counted by a counter 70, the result of the count being input to the microcomputer. In accordance with commands stored in the ROM 58, the CPU 56 of the microcomputer computes the quantity of fuel injection in a manner explained later and drives the fuel injector 22 of the individual cylinders via a drive circuit 72.

Similarly, the CPU 56 calculates a manipulated variable and drives a solenoid valve (EACV) 74 (in FIG. 1) via a drive circuit (not shown) to control the quantity of secondary air passing the bypass 30.

Figure 3:
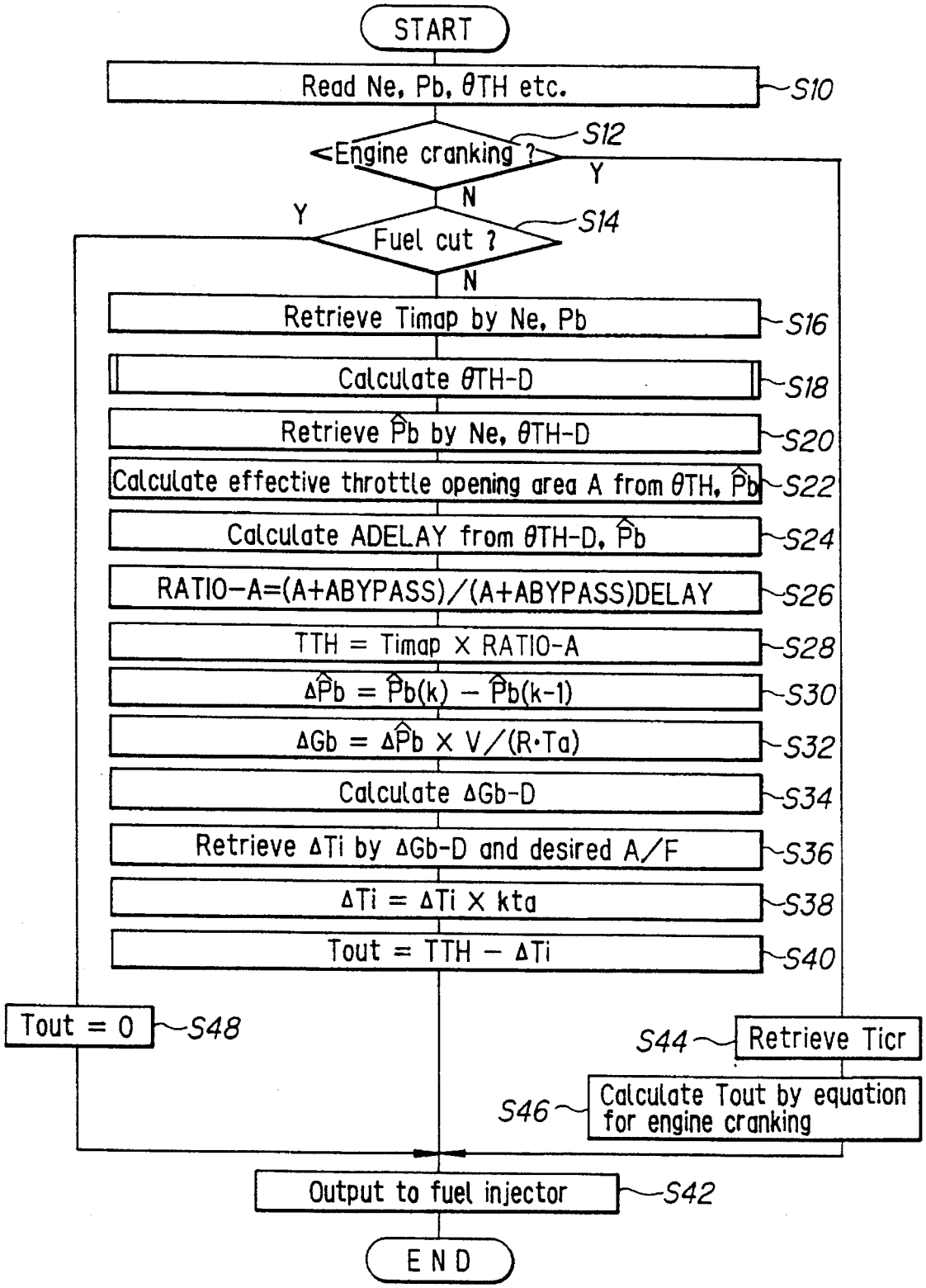
FIG. 3 is a flowchart showing the operation of the fuel metering control system according to the invention.

FIG. 3 is a flow chart showing the operation of the system. Before entering into the explanation of the figure, however, air flow estimation using a fluid dynamic model on which the invention is based, will first be explained. Since the method was fully described in the aforesaid assignee's earlier application, the explanation will be made in brief.

Figure 5:
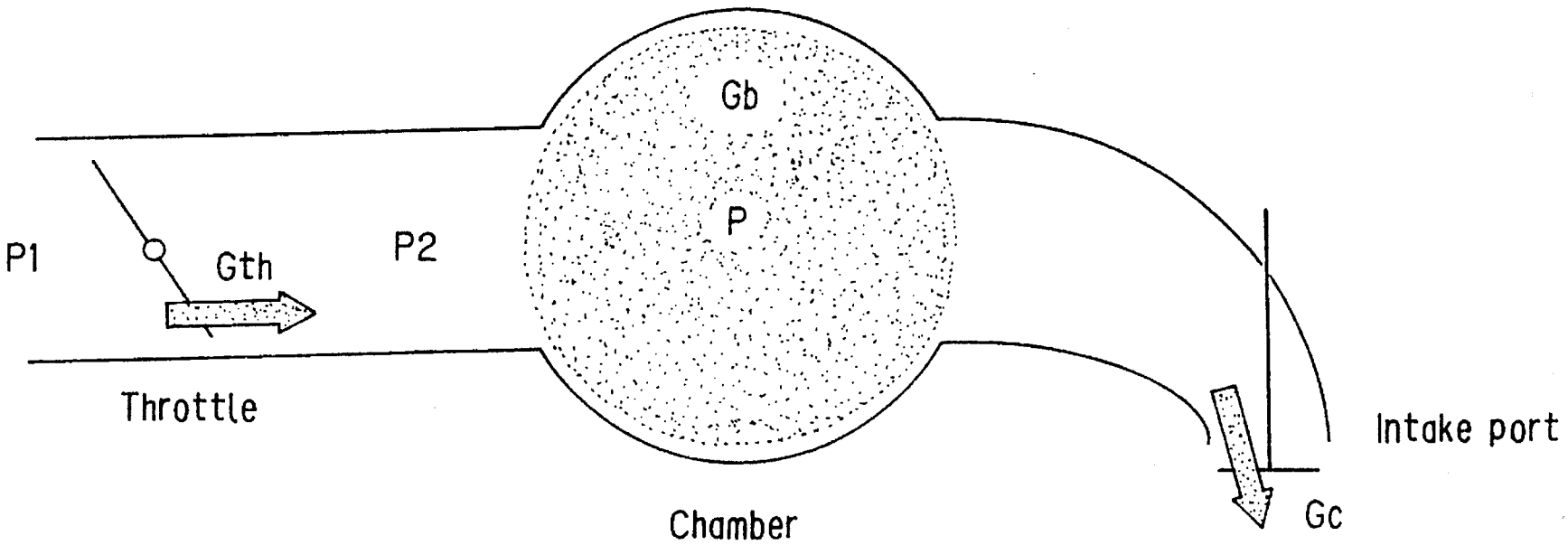
FIG. 5 is a view showing an air intake system model used in the system.

First, if the throttle (valve) is viewed as an orifice as shown in an air intake system model of FIG. 5, it is possible from Eq. 1 (Bernoulli's equation), Eq. 2 (equation of continuity) and Eq. 3 (relational equation of adiabatic process) to derive Eq. 4, which is the standard orifice equation for compressible fluid flow. Eq. 4 can be rewritten as Eq. 5 and based on it, it is thus possible to determine the quantity of throttle-past air Gth per unit time:

$$\frac{v_1^2}{2}+\frac{\kappa}{\kappa-1}\cdot\frac{P_1}{\rho_1}=\frac{v_2^2}{2}+\frac{\kappa}{\kappa-1}\cdot\frac{P_2}{\rho_2} \quad \text{Eq. 1}$$

where the flow is assumed to be the adiabatic process, and $P_1$: Absolute pressure on upstream side $P_2$: Absolute pressure on downstream side $\rho_1$: Air density on upstream side $\rho_2$: Air density on downstream side $v_1$: Flow velocity on upstream side $v_2$: Flow velocity on downstream side $\kappa$: Specific-heat ratio $$\rho_1\cdot v_1\cdot A_{up}=\rho_2\cdot v_2\cdot S \quad \text{Eq. 2}$$

where:

$A_{up}$: Flow passage area on upstream side

S: Throttle projection area [=f(θTH)]

$$\frac{P_1}{\rho_1\kappa}=\frac{P_2}{\rho_2\kappa} \quad \text{Eq. 3}$$

$$Gth=\epsilon\cdot\rho_1\cdot\alpha\cdot S\cdot\sqrt{\frac{2g\cdot(P_1-P_2)}{\gamma_1}} \quad \text{Eq. 4}$$

where:

g: Gravitational acceleration $\gamma_1$: Air specific weight on upstream side ($=\rho_1\cdot g$)

α; Flow rate coefficient (coefficient of discharge)

$$\left(=\frac{C_v\cdot C_c}{\sqrt{1-C_c^2\,(d/D)^4}}\right.$$

where:

$C_v$: Velocity coefficient $C_c$: Contraction coefficient [$=f(S/A_{up})$]

$D$: Bore diameter on upstream side $d$: Throttle aperture diameter

ε: Correction coefficient (expansion factor of gas)

-continued $$\left(\frac{\left(\frac{\kappa}{\kappa-1}\right)\left(\left(\frac{P_2}{P_1}\right)^{(2/\kappa)}-\left(\frac{P_2}{P_1}\right)^{((\kappa+1)/\kappa)}\right)(1-C_c^2\,(d/D)^4)}{(1-P_2/P_1)\left(1-\left(\frac{P_2}{P_1}\right)^{(2/\kappa)}\cdot C_c^2\,(d/D)^4\right)}\right)$$

$$\begin{aligned} Gth &= \epsilon\cdot\rho_1\cdot\alpha\cdot S\cdot\sqrt{\frac{2g\cdot(P_1-P_2)}{\gamma_1}} \\ &= C\cdot S\cdot\rho_1\cdot\sqrt{\frac{2g\cdot(P_1-P_2)}{\gamma_1}} \\ &= A\cdot\rho_1\cdot\sqrt{\frac{2g\cdot(P_1-P_2)}{\gamma_1}} \\ &\approx A\cdot\rho_1\cdot\sqrt{\frac{2g\cdot(Pa-Pb)}{\gamma_1}} \end{aligned} \quad \text{Eq. 5}$$

where:

$C=\epsilon\cdot\alpha$ $A=C\cdot S$

S: Throttle projection area

A: Effective throttle opening area

Pa: Atmospheric pressure

Pb: Manifold absolute pressure

Figure 6:
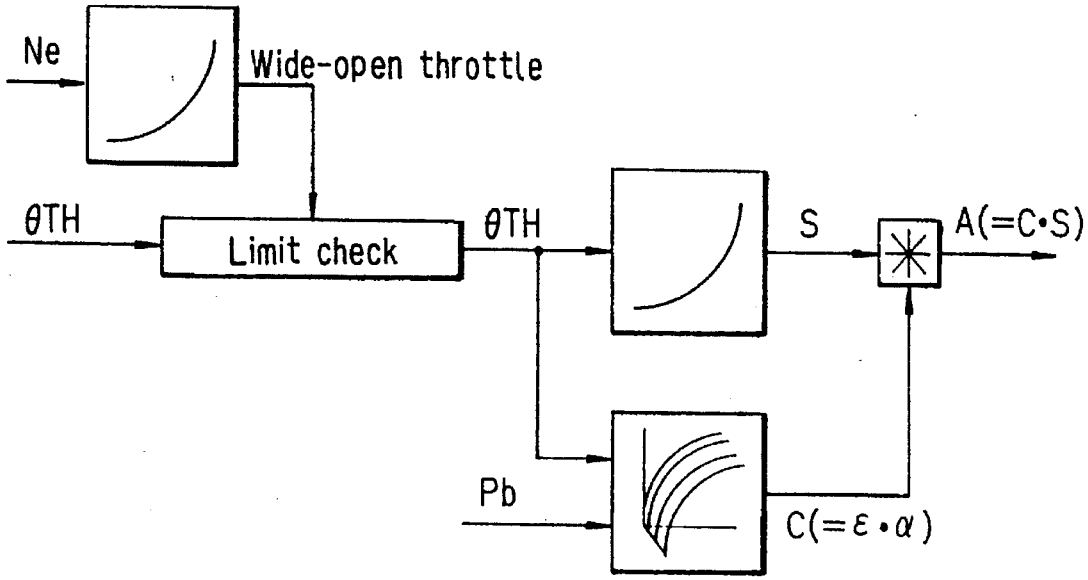
FIG. 6 is a block diagram showing the calculation of an effective throttle opening area and its first-order lag value used in the calculation of the system.
Figure 7:
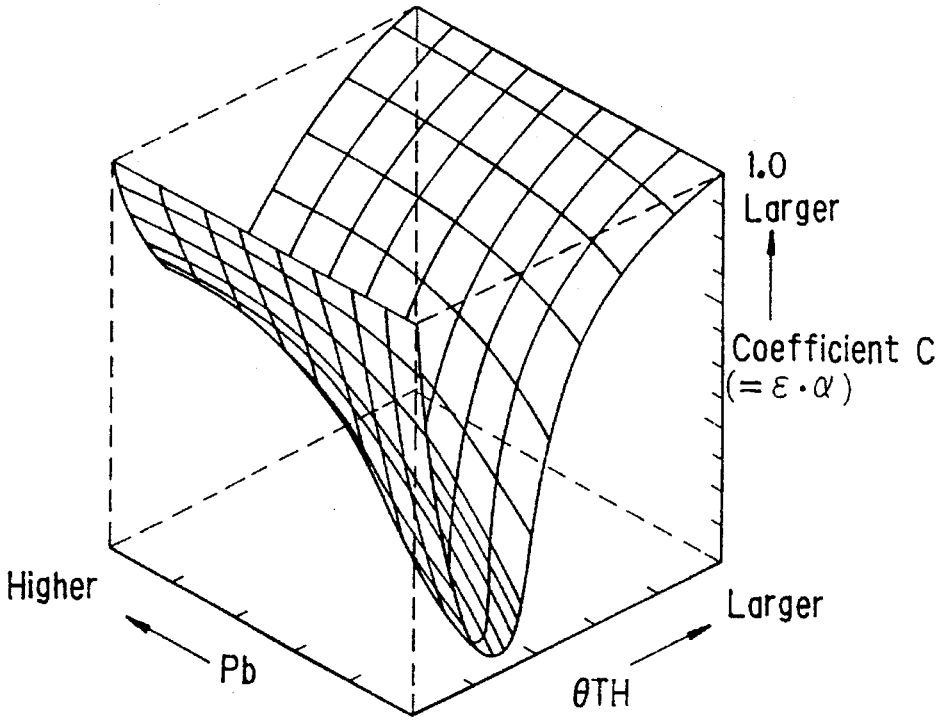
FIG. 7 is a view showing a characteristic of mapped data of a coefficient shown in FIG. 6.

More specifically, on the basis of the detected throttle (valve) opening θTH, the throttle's projection area S (formed on a plane perpendicular to the longitudinal direction of the air intake pipe 12 when the throttle valve 16 is assumed to be projected in that direction) is determined in accordance with a predetermined characteristic, as illustrated in the block diagram of FIG. 6. At the same time, the discharge coefficient C which is the product of the flow rate coefficient α and gas expansion factor epsilon, is retrieved from mapped data whose characteristic is illustrated in FIG. 7 using the throttle opening θTH and manifold pressure Pb as address data, and the throttle projection area S is multiplied by the coefficient C retrieved to obtain the effective throttle opening area A. According to Eq. 5, the value A is multiplied by the air specific weight rho 1 and the root to determine the quantity of throttle-past air Gth. Here, the pressures P1, P2 in the root can be substituted by atmospheric pressure Pa and manifold pressure Pb. Since the throttle does not function as an orifice in its wide-open (full-throttling) state, the full load opening areas are predetermined empirically as limited values with respect to engine speed. And when a detected throttle opening is found to exceed the limit value concerned, the detected value is restricted to the limit value.

Next, the quantity of chamber-filling air, referred hereinafter to as "Gb", is calculated by using Eq. 6, which is based on the ideal gas law. The term "chamber" is used here to mean not only the part corresponding to the so-called surge tank but to all portions extending from immediately downstream of the throttle to immediately before the cylinder intake port:

$$Gb(k)=\frac{V}{R\cdot T}\cdot P(k) \quad \text{Eq. 6}$$

where:

V: Chamber volume

T: Air temperature

R: Gas constant

P: Chamber pressure

Then, the quantity of chamber-filling air at the current control cycle delta Gb(k) can be obtained from the pressure change in the chamber delta P using Eq. 7. It should be noted that "k" means the current control (program) cycle and "k–n" the control cycle at a time n earlier in the discrete control system, but the appending of the suffix (k) is omitted for most values at the current control cycle in this specification.

$$\Delta Gb(k) = Gb(k) - Gb(k-1) = \frac{V}{R \cdot T} \cdot (P(k) - P(k-1)) = \frac{V}{R \cdot T} \cdot \Delta P(k) \quad \text{Eq. 7}$$

When it is assumed that the quantity of chamber-filling air delta Gb(k) at the current control cycle is not, as a matter of fact, inducted into the cylinder, then the actual quantity of air drawn in the cylinder Gc per time unit delta T can be expressed as Eq. 8:

$$Gc = Gth \cdot \Delta T - \Delta Gb \quad \text{Eq. 8}$$

Figure 8:
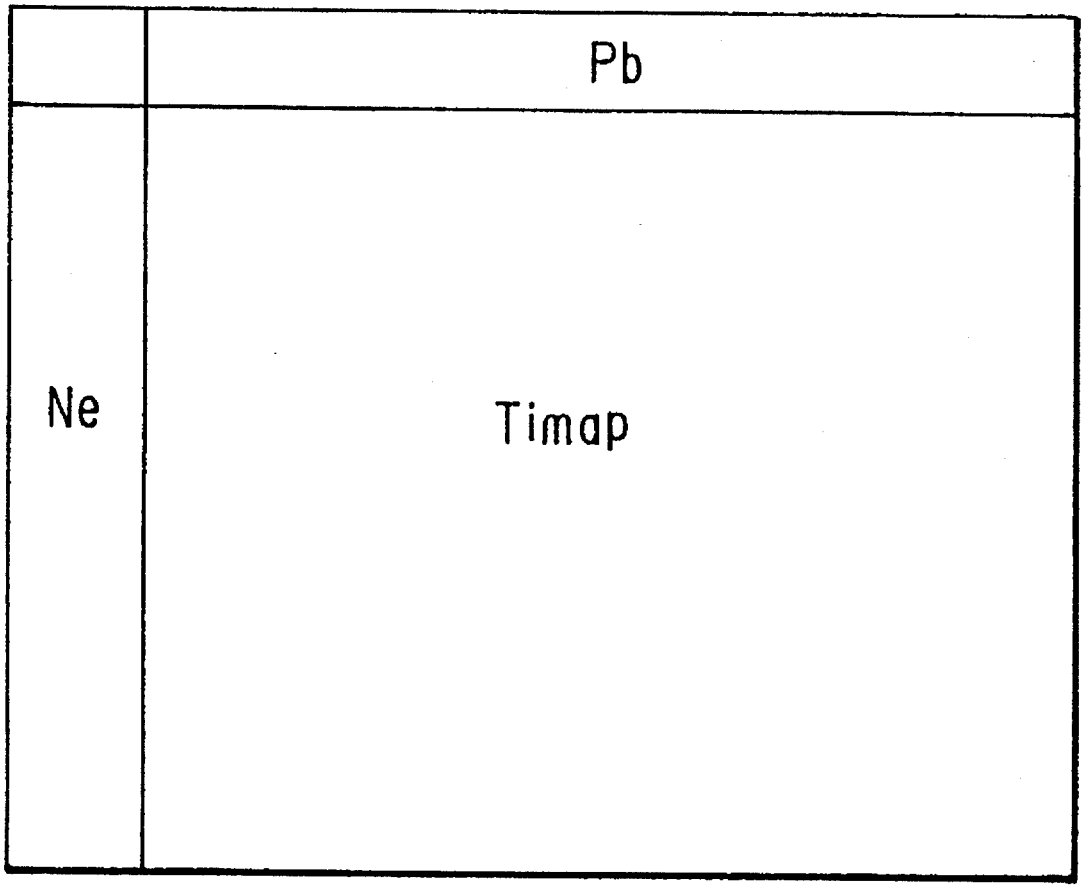
FIG. 8 is a view explaining a characteristic of mapped data of the quantity of fuel injection under the steady-state engine operating condition Timap.

On the other hand, the quantity of fuel injection under the steady-state engine operating condition Timap is prepared in advance in accordance with the so-called speed density method and stored in the ROM 58 as mapped data with respect to engine speed Ne and manifold pressure Pb as illustrated in FIG. 8. Since the quantity of fuel injection Timap is established in the mapped data in accordance with a desired air/fuel ratio which in turn is determined in accordance with the engine speed Ne and the manifold pressure Pb, the desired air/fuel ratio is therefore prepared in advance and stored as mapped data with respect to the same parameters as shown in FIG. 9 to be later used for determining the quantity of correction delta Ti for correcting the quantity of fuel injection Timap. The quantity of fuel injection Timap is established such that it satisfies the aforesaid fluid dynamic model under the steady-state engine operating condition. Specifically, the quantity of fuel injection Timap is established in terms of the opening period of the fuel injector 22.

Here, when contemplating the relationship between the quantity of fuel injection Timap retrieved from the mapped data and the quantity of throttle-past air Gth, the quantity of fuel injection Timap retrieved from the mapped data, here referred to as Timap1, will be expressed as Equation 9 at a certain aspect under the stable-state engine operating condition defined by engine speed Ne1 and manifold pressure Pb1:

$$Timap1 = \text{MAPPED DATA } (Ne1, Pb1) \quad \text{Eq. 9}$$

In that situation, the quantity of fuel injection determined theoretically from the aforesaid fluid dynamic model, here referred to as Timap1', will be expressed as Equation 10 when the desired air/fuel ratio is set to be the stoichiometric air/fuel ratio (14.7:1). Here, the value with symbol "'" indicates that value determined theoretically from the fluid dynamic model. The suffix "1" appended to the parameters indicates a specific value at the steady-state engine operating condition, while the suffix "2" (appearing later) indicates a specific value at the transient engine operating condition:

$$Timap1' = Gth1 \cdot \Delta T/14.7 \quad \text{Eq. 10}$$

$$\text{where } Gth1 = A1 \cdot \rho 1 \cdot \sqrt{2g \frac{Pa - Pb1}{\gamma_1}}$$

Figure 10:
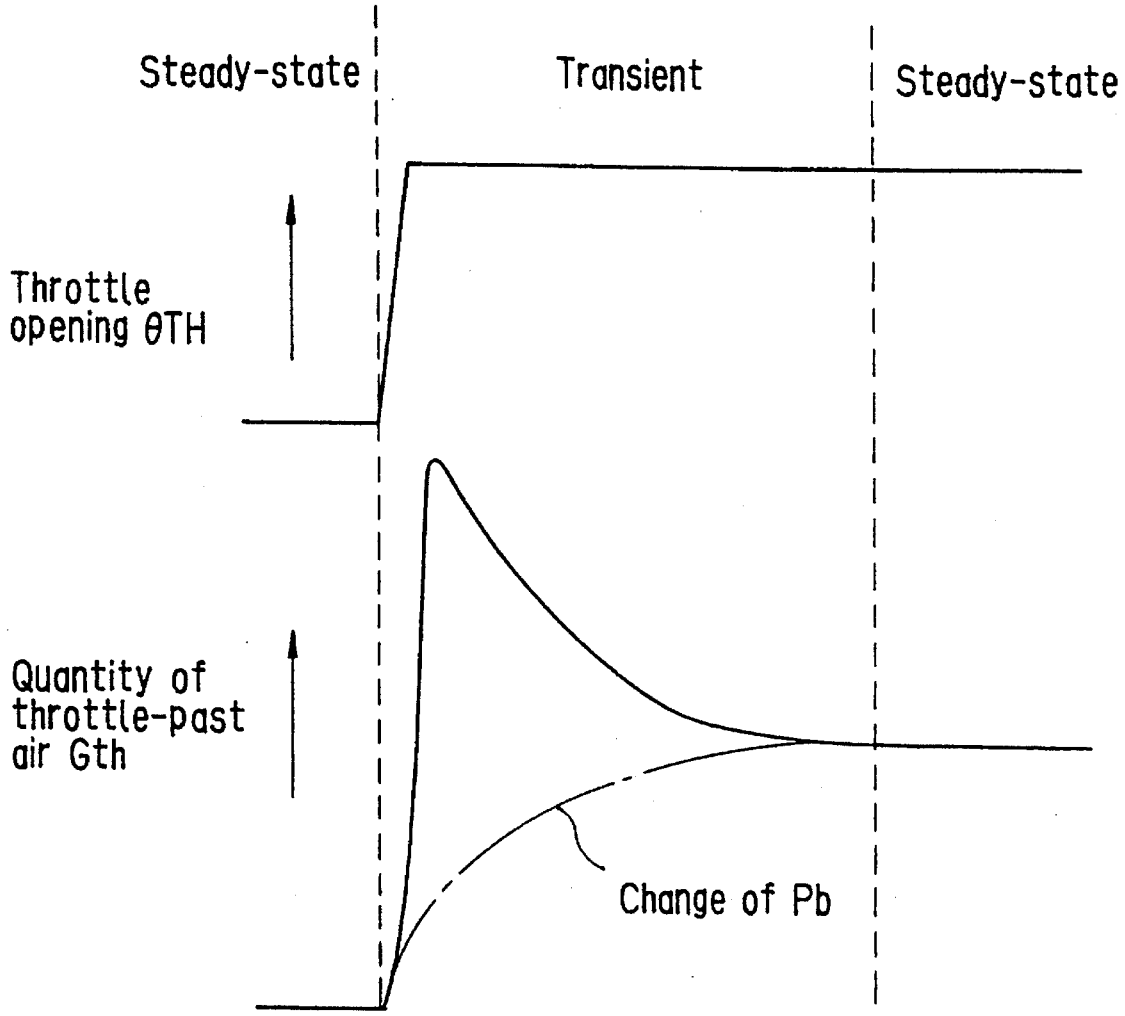
FIG. 10 is a timing chart explaining the transient engine operating condition referred to in the specification.

Assuming that the mapped data are prepared to satisfy the model equations as mentioned before, the quantity of fuel injection Timap1 retrieved from the mapped data and the quantity of fuel injection Timap1' obtained from the model equations become equal. Then, when retrieving the quantity of fuel injection from the mapped data at the same condition (i.e., Ne=Ne1, Pb=Pb1) during the transient engine operating condition, it will be the same as that under the steady-state engine operating condition as shown in Eq. 11. Here, in the specification "the transient engine operating condition" is used to mean a transitional phase between the steady-state engine operating conditions as illustrated in FIG. 10:

$$Timap1 = \text{MAPPED DATA } (Ne1, Pb1) \quad \text{Eq. 11}$$

On the other hand, the quantity of fuel injection Timap2' determined from the model equations will be expressed as Eq. 12 and will not be the same as the value retrieved from the mapped data:

$$Timap2' = Gth2 \cdot \Delta T/14.7 - \Delta Gb2/14.7 \quad \text{Eq. 12}$$

where, $$Gth2 = A2 \cdot \rho 1 \cdot \sqrt{2g \frac{Pa - Pb1}{\gamma_1}}$$

In order to solve the discrepancy therebetween, it therefore becomes necessary to conduct complicated calculations based on the fluid dynamic model.

Here, however, when comparing the quantity of throttle-past air Gth1 under the steady-state engine operating condition shown in Eq. 10 and Gth2 under the transient engine operating condition shown in Eq. 12, it can be found that the difference is related only to the effective throttle opening area A. Accordingly, the quantity of throttle-past air Gth2 under the transient engine operating condition can be expressed as Eq. 13:

$$Gth2 = \frac{A2}{A1} Gth1 \quad \text{Eq. 13}$$

In other words, it is possible to determine the quantity of throttle-past air Gth2 under the transient operating condition from the quantity of throttle-past air Gthl under the steady-state engine operating condition and a ratio between the effective throttle opening areas A1, A2 of both conditions.

On the other hand, since the quantity of throttle-past air Gthl under the steady-state engine operating condition can be obtained from the quantity of fuel injection Timap1 retrieved from the mapped data as shown in Eq. 14, the quantity of throttle-past air Gth2 under the transient engine operating condition can be obtained in a manner shown in Eq. 15:

$$Gth1 = Timap1' \cdot 14.7/\Delta T = Timap1 \cdot 14.7/\Delta T \quad \text{Eq. 14}$$

$$Gth2 = \frac{A2}{A1} Timap1 \cdot 14.7/\Delta T \quad \text{Eq. 15}$$

Using Eqs. 12 and 15, as a result, it becomes possible to determine the quantity of fuel injection Timap2' under the transient engine operating condition from the basic quantity of fuel injection Timapl retrieved from the mapped data, the ratio A2/A1 between the effective throttle opening areas and the quantity of correction delta Ti corresponding to the quantity of chamber-filling air delta Gb2, as expressed in Eq. 16:

$$Timap2' = \frac{A2}{A1} Timap1 - \Delta Ti$$

where $$\Delta Ti = (\Delta Gb2/14.7) \times ki \quad \text{Eq. 16}$$

In Eq. 16, "ki" is a coefficient for converting the quantity of fuel injection into an injector's opening period.

Figure 11:
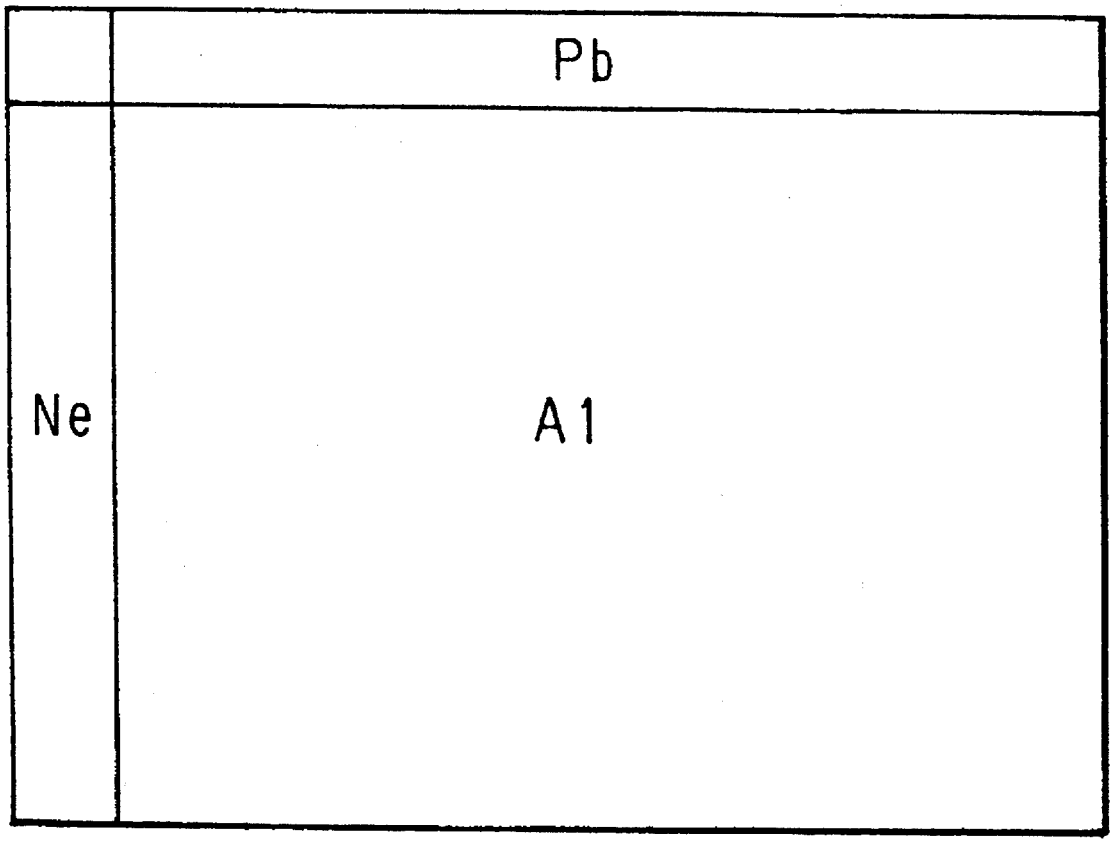
FIG. 11 is a view explaining a characteristic of mapped data of an effective throttle opening area under the steady-state engine operating condition.
Figure 12:
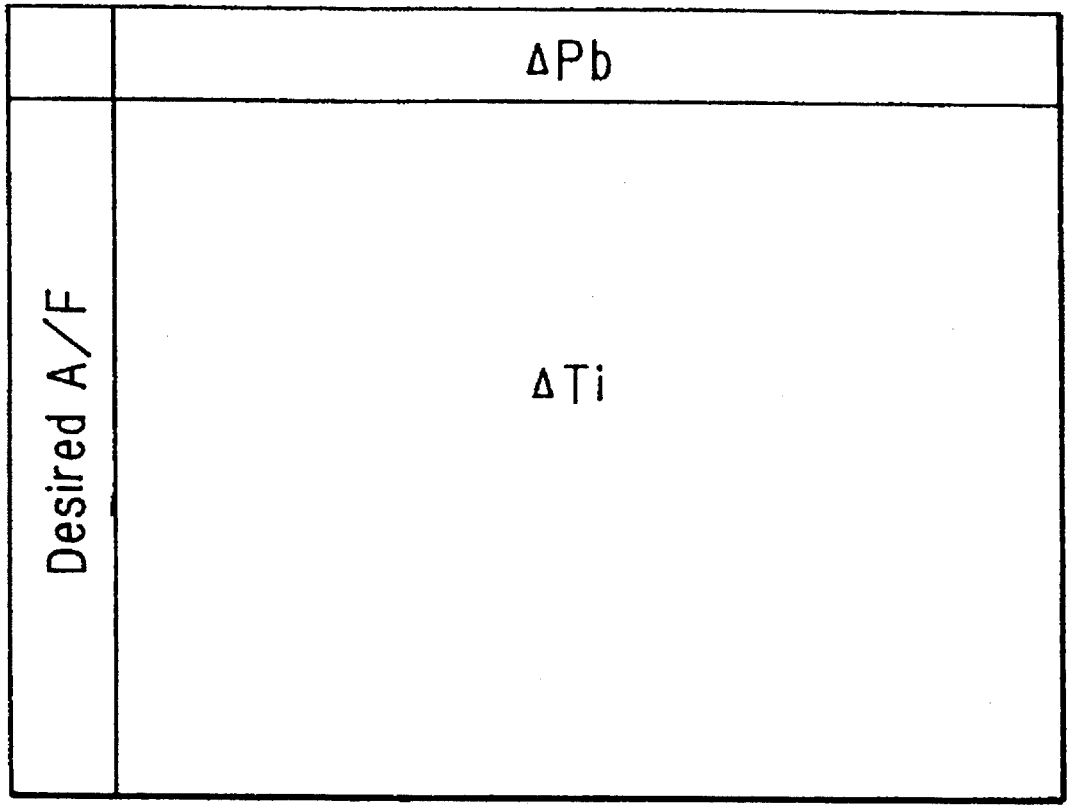
FIG. 12 is a view explaining a characteristic of mapped data of the quantity of correction delta Ti for correcting the quantity Timap.

Therefore, it is arranged such that the effective throttle opening area A1 under the steady-state engine operating condition is calculated in advance and stored as mapped data using engine speed Ne and manifold pressure Pb as address data as illustrated in FIG. 11 in a similar manner to the quantity of fuel injection Timap. Moreover, the quantity of correction delta Ti for correcting the quantity of fuel injection Timap is similarly prepared in advance and stored in the memory in such a manner that it can be retrieved by manifold pressure change delta Pb (the difference between the detected manifold pressure Pb at the current control cycle and that at the last control cycle) and the desired air/fuel ratio (the same ratio used for Timap is to be selected for harmonization), as illustrated in FIG. 12.

Then, after determining the current effective throttle opening area A and obtaining the ratio A/A1 between A and the map-retrieval effective throttle opening area A1, it is possible to determine the output quantity of fuel injection Tout by multiplying the ratio by the quantity of fuel injection Timap and by subtracting the quantity of correction delta Ti. Under the steady-state engine operating condition in which manifold pressure does not change, the quantity of fuel injection Timap will immediately be the output quantity of fuel injection Tout as shown in Eq. 17. Under the transient engine operating condition, the output quantity of fuel injection Tout will be calculated according to the equation shown in Eq. 18:

$$Tout = \frac{A1}{A1} Timap1 - 0 = Timap1 \quad \text{Eq. 17}$$

$$Tout = \frac{A2}{A1} Timap1 - \Delta Ti \quad \text{Eq. 18}$$

It is thus expected that the output quantity of fuel injection Tout is determined even under the transient engine operating condition in the same manner as under the steady-state engine operating condition, ensuring continuity in the fuel metering control. Moreover, even when the effective throttle opening area A1 obtained from mapped data retrieval does not coincide with the current effective throttle opening area A under the steady-state engine operating condition, the output quantity of fuel injection Tout will be determined as shown in Eq. 19, so that it is expected that any factor such as mapped data's initial variance that causes the discrepancy will then be automatically corrected:

$$Tout = \frac{A2}{A1} Timap1 - 0 \quad \text{Eq. 19}$$

However, after validating the control through repeated computer simulations, it has been found that the effective throttle opening area A1 did not coincide with the current effective throttle opening area A under the steady-state engine operating condition, and A/A1 does not become 1. Further, measuring the behavior of the quantity of chamber-filling air at the current control cycle delta Gb which was expected to occur when the quantity of throttle-past air increases, it has been found that there was a lag until the quantity of chamber-filling air at the current control cycle was reflected in the quantity of air drawn in the cylinder. The reason for this would be the inconsistency in the sensor detection timings and sensor detection lags, in particular the detection lag of the manifold absolute pressure sensor 38.

Figure 4:
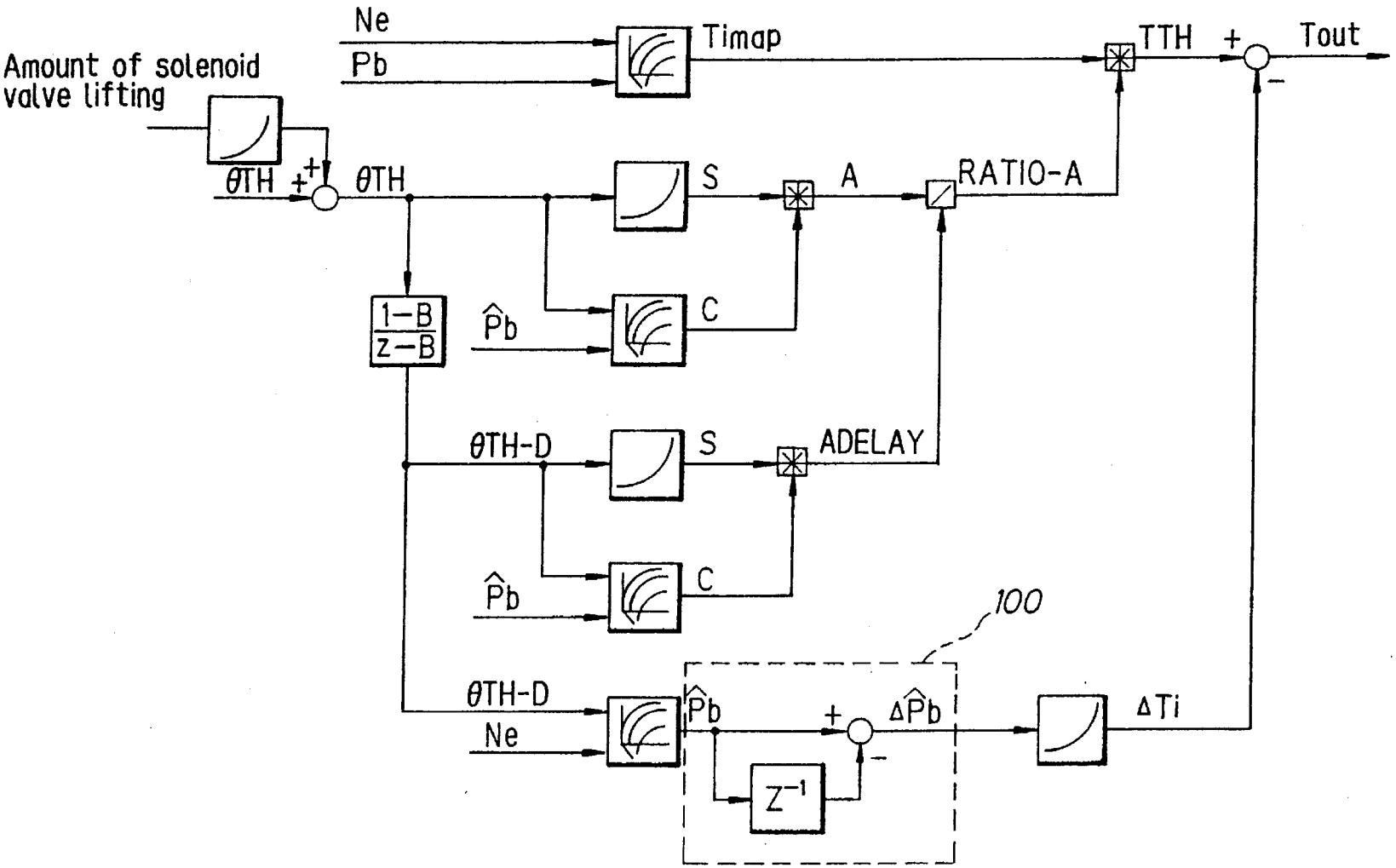
FIG. 4 is a block diagram similarly showing the operation of the system according to the invention.

Then, observing the relationship between the throttle opening θTH and manifold pressure Pb, it has been found that when the engine speed is constant in an engine environment where the engine coolant temperature and the atmospheric pressure, etc., remain unchanged, the manifold pressure can be solely determined from the throttle opening when the engine is under the steady-state operating condition. Even under the transient engine operating condition illustrated in FIG. 10, it can be considered that the manifold pressure has the first-order lag relationship with the change of the throttle opening. Based on the observation, as is illustrated in FIG. 4, the system is now rearranged such that the first-order lag value of the throttle opening (the lag referred hereinafter to as "θTH-D"), is first obtained and from the value θTH-D and the engine speed Ne, a second value is obtained in accordance with a predetermined characteristic, a pseudo-value (hereinafter referred to as "pseudo-manifold pressure P̂b") is obtained. With the arrangement, it has been considered that the sensor's detection timing gap and the manifold pressure sensor's detection lag can be solved.

Figures 13, 13A:
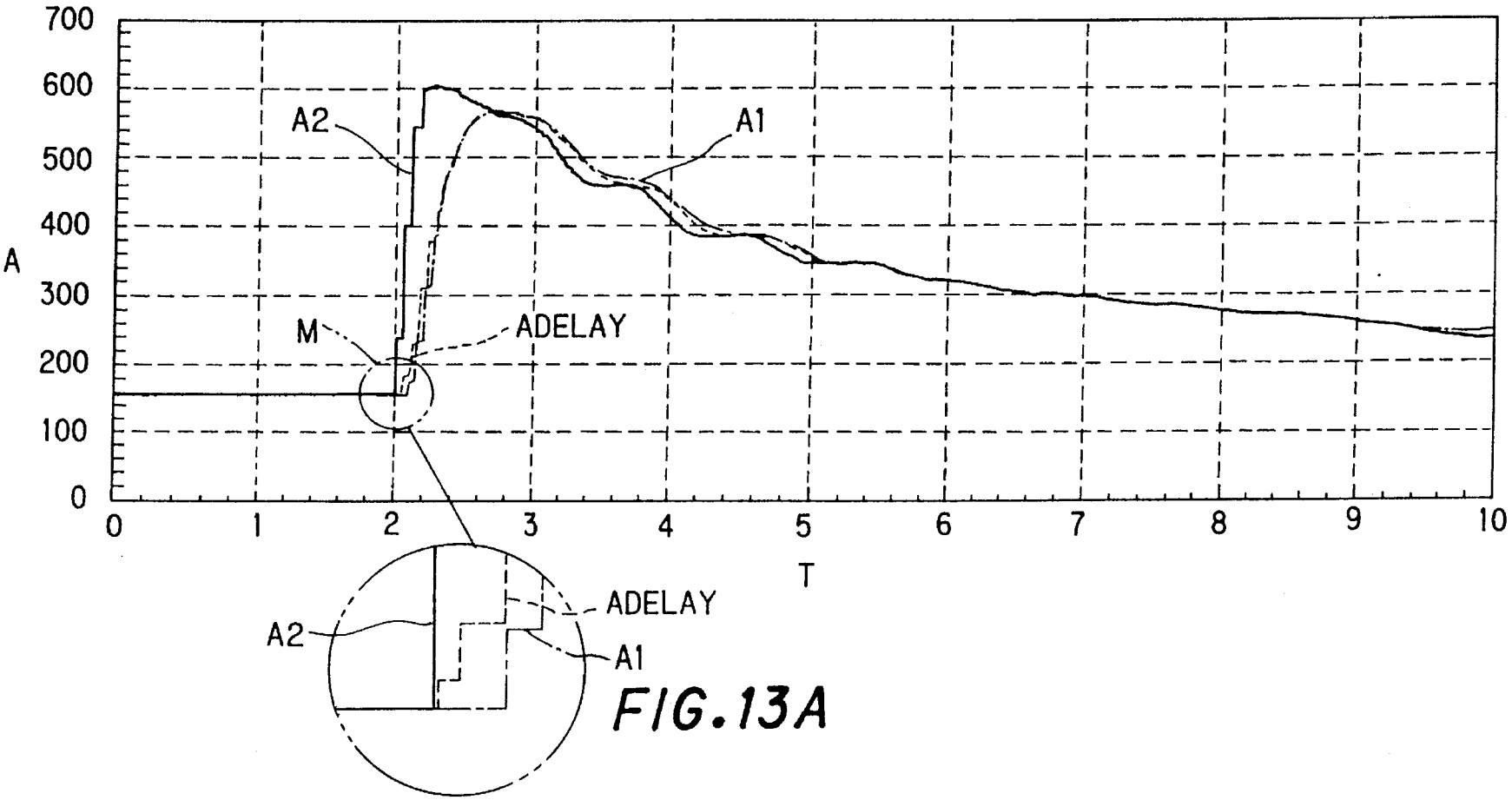
FIGS. 13 and 13A are graphs showing the result of simulation using an effective throttle opening area's first-order lag value.

Observing further the behavior of the effective throttle opening area, it is considered that the aforesaid value A1 retrieved from the mapped data is able to be determined from the first-order lag value of the current effective throttle opening area A. And after verifying it through computer simulations, it has been validated as shown in FIG. 13. More specifically, when the first-order lag value of the area A is called "ADELAY", comparing A2/A1 with A/ADELAY, leads to comparing A1 and ADELAY, provided that A2 is identical to A. It can be found that A1 rises behind the rise of A2(A) due to the manifold pressure sensor's detection lag, whereas the value ADELAY follows A2(A) relatively faithfully, as is illustrated in FIG. 13A. Accordingly, the system is rearranged such that, instead of the aforesaid ratio A/A1, the ratio A/its first-order lag value ADELAY is used hereinafter. Under the transient engine operating condition, when the throttle valve is opened, a large quantity of air passes the throttle valve all at a time due to the large pressure difference across the throttle valve and then the quantity of air decreases gradually to that under the steady-state engine operating condition as was mentioned before with reference to the bottom of FIG. 10. It is considered that the ratio A/ADELAY can describe the quantity of throttle-past air Gth under such an engine transient operating condition. Under the steady-state engine operating condition, the ratio becomes 1 as will be understood from FIG. 14B. The ratio is referred to as "RATIO-A" as mentioned earlier.

Figure 14A:
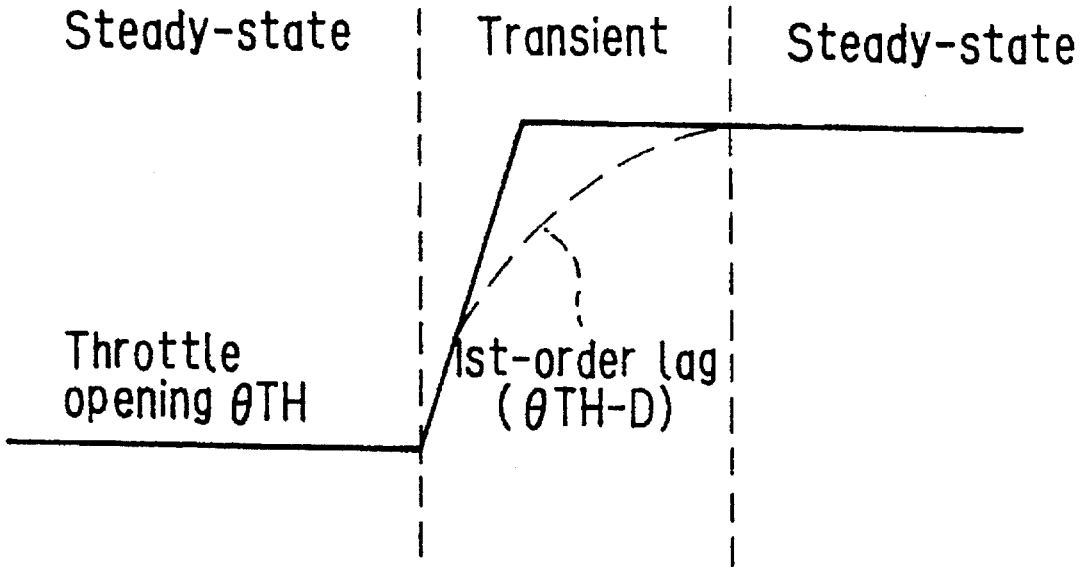
FIGS. 14A and 14B area timing charts explaining the effective throttle opening area's first-order lag value.
Figure 14B:
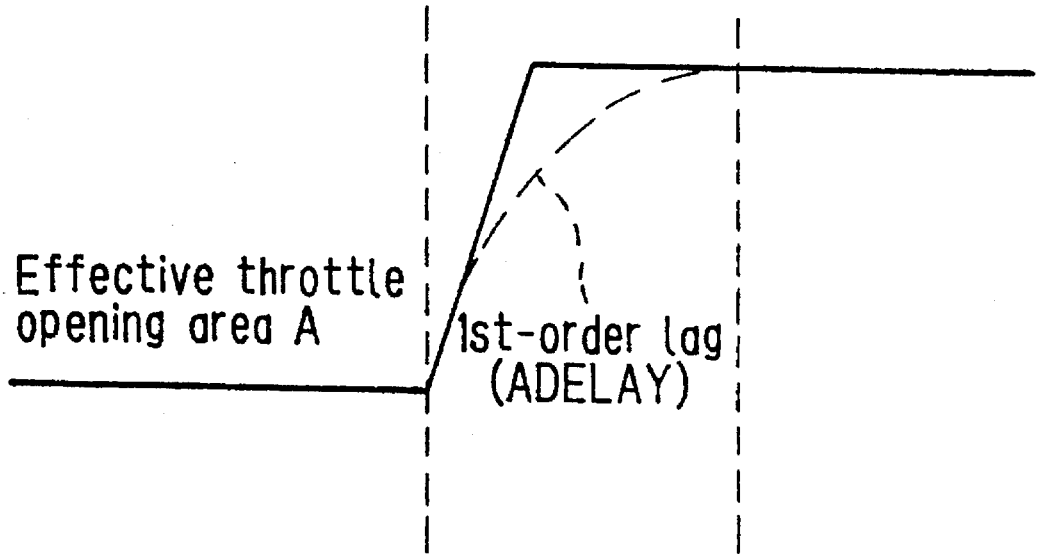

Furthermore, when viewing the relationship between the effective throttle opening area and the throttle opening, since the effective throttle opening area depends greatly on the throttle opening as was shown in Eq. 5, it is considered that the effective throttle opening area will vary almost faithfully following the change of the throttle opening, as illustrated in FIGS. 14A and 14B. If this is true, it can be said that the aforesaid throttle opening's first-order lag value will nearly correspond, in the sense of phenomenon, to the effective throttle opening area's first-order lag value.

In view of the above, it is arranged as illustrated in FIG. 4 such that, the effective throttle opening area's first-order lag value ADELAY is calculated primarily from the first-order of the throttle opening. In the figure, (1−B)/(z−B) is a transfer function of the discrete control system and means the value of the first-order lag.

As illustrated, more specifically, the throttle's projection area S is determined from the throttle opening θTH in accordance with a predetermined characteristic and the discharge coefficient C is determined from the throttle opening's first-order lag value θTH-D and the pseudo-manifold pressure P̂b in accordance with a characteristic similar to that shown in FIG. 7. Then the product of the values is obtained to determine the effective throttle opening area's first-order lag value ADELAY. Thus, as shown in FIG. 4, the first-order lag value θTH-D is first used for determining the effective throttle opening area's first-order lag value ADELAY and is second used to determine, together with the engine speed, the pseudo-manifold pressure P̂b.

Figure 15:
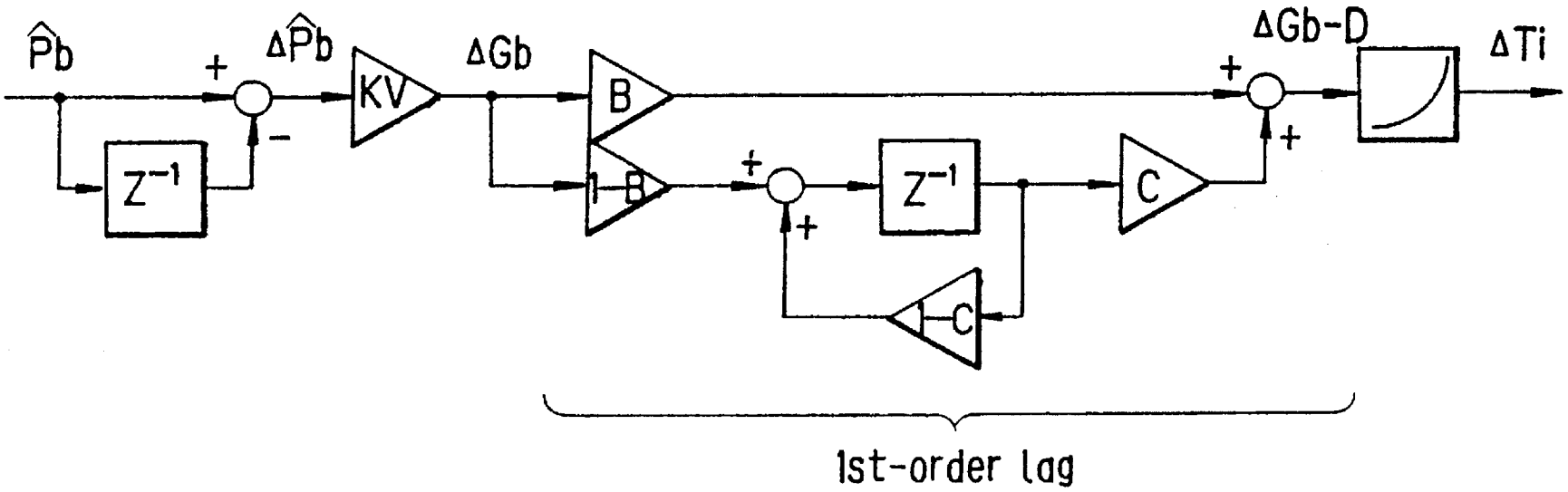
FIG. 15 is a block diagram showing the detailed structure of a portion of the block diagram illustrated in FIG. 4.

Furthermore, in order to solve the current quantity of chamber-filling air delta Gb's reflection lag to the quantity of air drawn in the cylinder, the first-order lag value of the value delta Gb is further used. That is; as shown in FIG. 15 which is a block diagram showing the details of a portion 100 in FIG. 4, the value of the first-order lag value of the current quantity of chamber-filling air delta Gb (hereinafter referred to as "delta Gb-D") is obtained. And based on the value delta Gb-D, the quantity of correction delta Ti is determined. This is done, after preestablishing a characteristic, not illustrated, similar to that shown in FIG. 12 with respect to the desired air/fuel ratio and the quantity of chamber-filling air's first-order lag value delta Gb-D and by retrieving the parameters. It should be noted that in FIG. 15, time constants of the first-order lag are determined appropriately through tests.

Based on the above, the operation of the system will be explained with reference to the flowchart of FIG. 3.

The program begins at step S10 in which engine speed Ne, manifold pressure Pb, throttle opening θTH or the like are read in, and the program proceeds to step S12 in which it is checked if the engine is cranking. If not, the program advances to step S14 in which it is checked if fuel cut is in progress and if not, to step S16 in which the quantity of fuel injection Timap is retrieved from the mapped data (whose characteristic is shown in FIG. 8 and stored in the ROM 58) using the engine speed Ne and manifold pressure Pb read in. Although the quantity of fuel injection Timap may then be subject to atmospheric pressure correction or the like, the correction itself is however not the gist of the invention and no explanation will here be made. The program then proceeds to step S18 in which the throttle opening's first-order lag value θTH-D is calculated.

Figure 17:
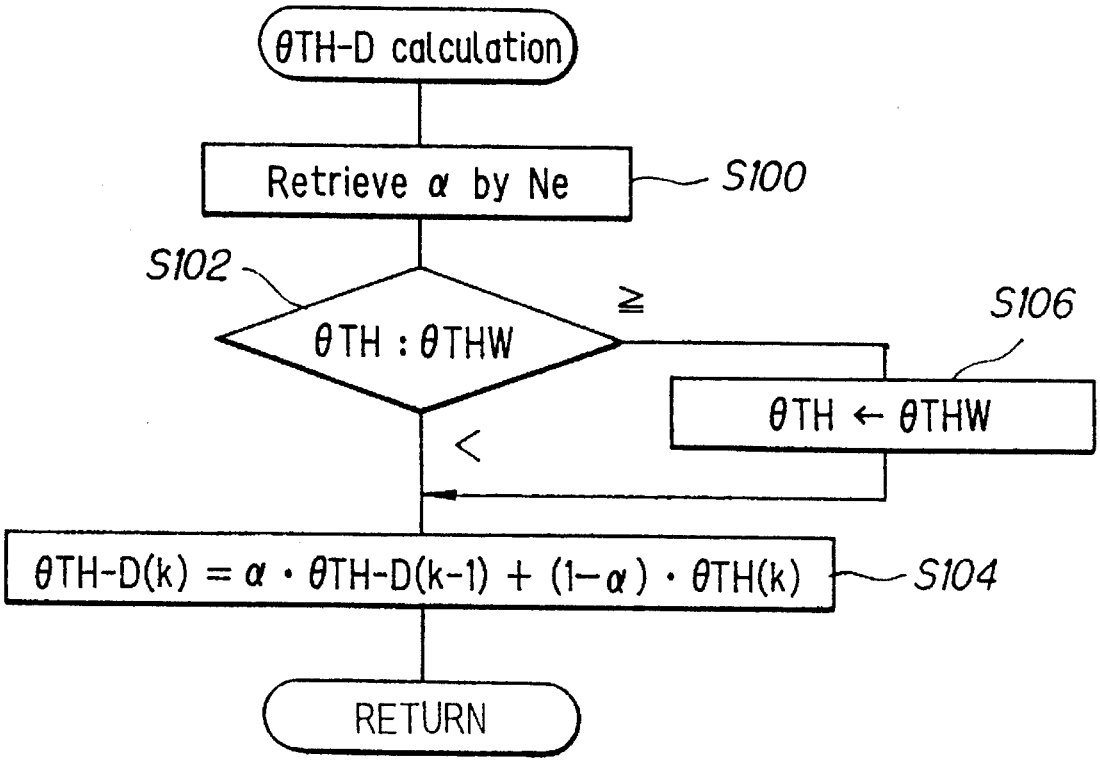
FIG. 17 is a subroutine flowchart of FIG. 3 showing the calculation of a throttle opening's first lag value.

FIG. 17 is a subroutine flowchart for the calculation.

In the figure, the program begins at step S100 in which a weight α is retrieved from a table (explained later) by the detected engine speed Ne, and proceeds to step S102 in which the detected throttle opening θTH is compared with a marginal limit (the aforesaid wide-open throttle limit) θTHW. When the detected throttle opening θTH is not less than the wide-open throttle opening limit θTHW at step S102, the program proceeds to step S106 in which the detected value is replaced with the marginal limit. On the other hand, when it is found that the detection value is less than the marginal limit, the program proceeds to step S104 in which the throttle opening's first-order lag value θTH-D is calculated in accordance with the equation shown there. Specifically, the value θTH-D(k) at the current control cycle is calculated by multiplying the value at the last control cycle θTH-D(k−1) by the value and multiplying the current throttle opening θTH(k) by a value obtained by subtracting α from 1 and then by adding the two products. In other words, the throttle opening's first-order lag value at the current control cycle is determined by calculating a weighted average between the value at the preceding control cycle and the throttle opening at the current control cycle.

Figure 18:
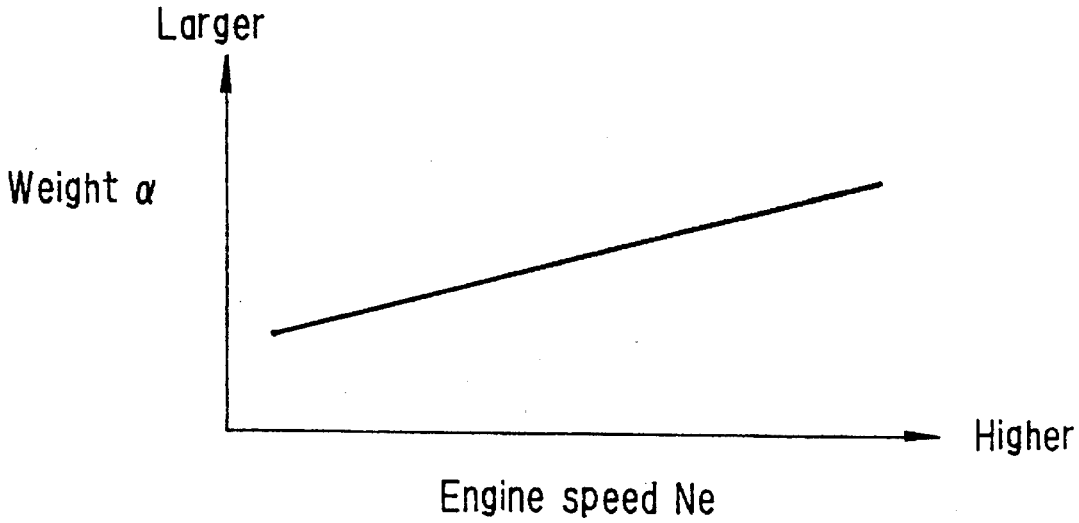
FIG. 18 is a graph showing a characteristic of a weight $\alpha$ used in the calculation of FIG. 17.
Figure 22:
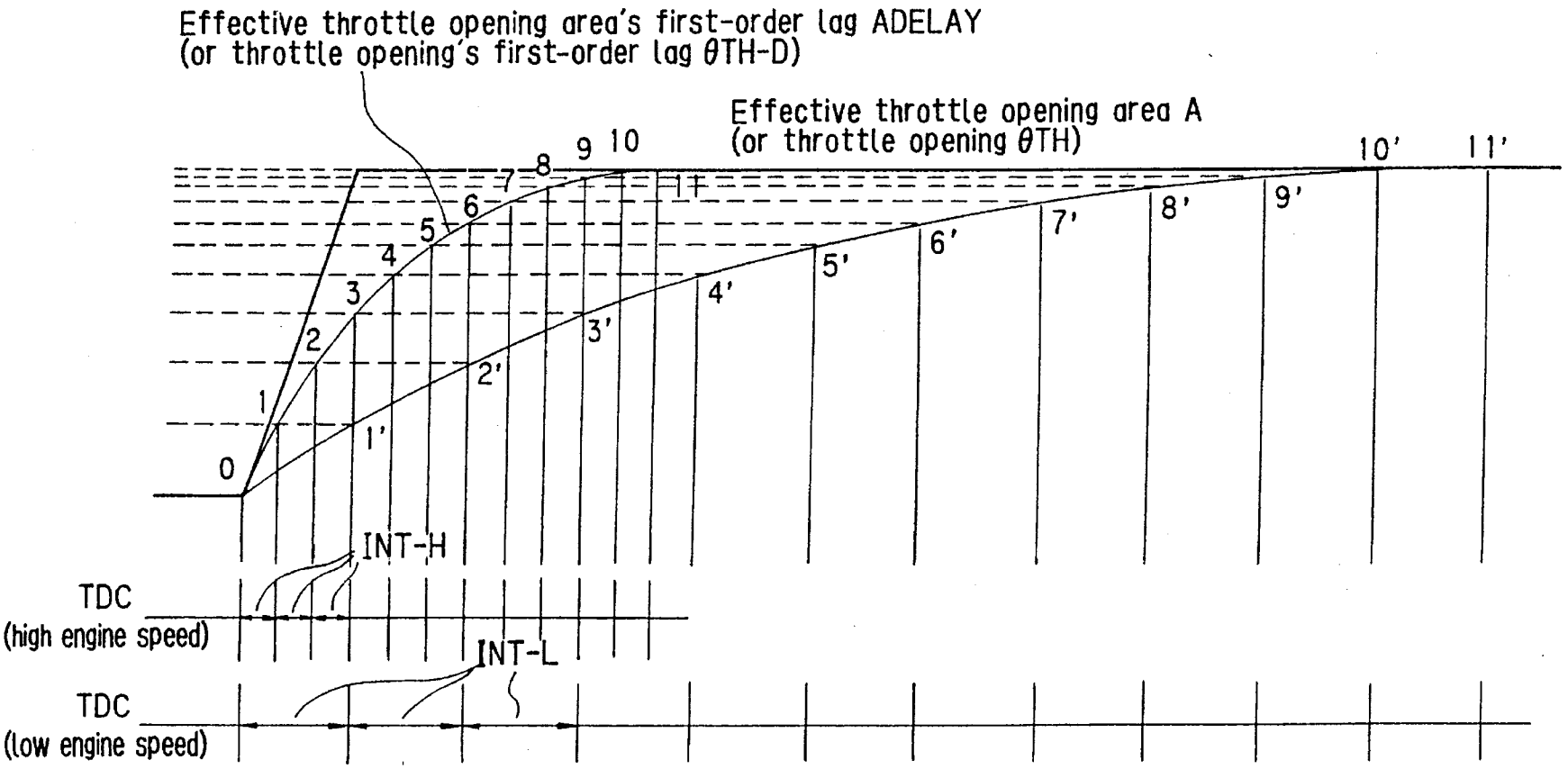
FIG. 22 is a timing chart explaining the influence of engine speed on the elongating/shortening of the TDC interval or control (calculation) cycle in the system.

FIG. 18 shows the characteristic of the table for the weight α. As illustrated, the weight α is determined in advance as retrievable by the engine speed Ne such that it decreases with decreasing engine speed. Since the weight α is preestablished to be smaller as the engine speed drops, the contribution of the throttle opening θTH(k) at the current control cycle becomes great or increases in the equation shown in step S104. As a result, it becomes possible to make the characteristic at a low engine speed almost equivalent to that at a high engine speed illustrated in FIG. 22. This enables the solution of the problem that the TDC interval (control (program) cycle) becomes longer as the engine speed rises, thus preventing the calculated value from becoming excessively large. In that sense, the weight α in the equation at step S104 can be said to a kind of time constant that determines the number or speed of control convergence. This will be the same as changing the time constant T in a general expression in Equation 20 describing the first lag system:

$$y(t)=1-e^{-VT} \qquad \text{Eq. 20}$$

Returning to FIG. 3, the program advances to step S20 in which the pseudo-manifold pressure P̂b is retrieved by the engine speed Ne and throttle opening's first-order lag value θTH-D (obtained through the procedures of FIG. 17), to step S22 in which the current effective throttle opening area A is calculated using the throttle opening θTH and the pseudo-manifold pressure P̂b, to step S24 in which the effective throttle opening area's first-order lag value ADELAY is calculated using the θTH-D and P̂b. The program then moves to step S26 in which the value RATIO-A is calculated in the manner shown therein, in which ABYPASS indicates a value corresponding to the quantity of air bypassing the throttle valve 16 such as that flowing in the path 30 and that is then inducted by the cylinder in response to the amount of lifting of the solenoid valve 74 (illustrated as "amount of solenoid valve lifting" in FIG. 4). Since it is necessary to take the quantity of bypass-air into account to accurately determine the quantity of fuel injection, the quantity of bypass air is determined in advance in terms of the effective throttle opening area as ABYPASS to be added to the effective throttle opening area A and the sum (A+ABYPASS) and the ratio (RATIO-A) between the first-order lag value of the sum (referred to as "(A+ABYPASS)DELAY") is calculated. Although it is not fully explained, an additional quantity of bypass air will be introduced when the EGR (Exhaust Gas Recirculation) or the canister purge is in operating, or the air-assist injector is in operation.

Since the value ABYPASS is added both to the numerator and denominator in the equation shown in step S26, even if there happens to be an error in measuring the quantity of throttle-bypass air, the determination of the quantity of fuel injection will not be damaged seriously. Furthermore, although a detailed explanation is omitted, the additive value is used for determining the pseudo-manifold pressure P̂b.

The program then proceeds to step S28 in which the quantity of fuel injection Timap is multiplied by the ratio RATIO-A to determine the quantity of fuel injection TTH corresponding to the quantity of throttle-past air Gth concerned. The program next advances to step S30 in which the difference between the value P̂b just retrieved in the current control (program) cycle, here referred to as "P̂b(k)", and the value retrieved in the last control cycle, here referred to as "P̂b(k−1)" is determined named delta P̂b, to step S32 in which the current quantity of chamber-filling air delta Gb is calculated from the ideal gas law, to step S34 in which its smoothed value, i.e., its first-order lag value delta Gb-D is calculated, to step S36 in which the quantity of correction delta Ti is retrieved from mapped data, whose characteristic is not illustrated but is similar to that shown in FIG. 12, using the value delta Gb-D and the desired air/fuel ratio as address data.

Figure 16:
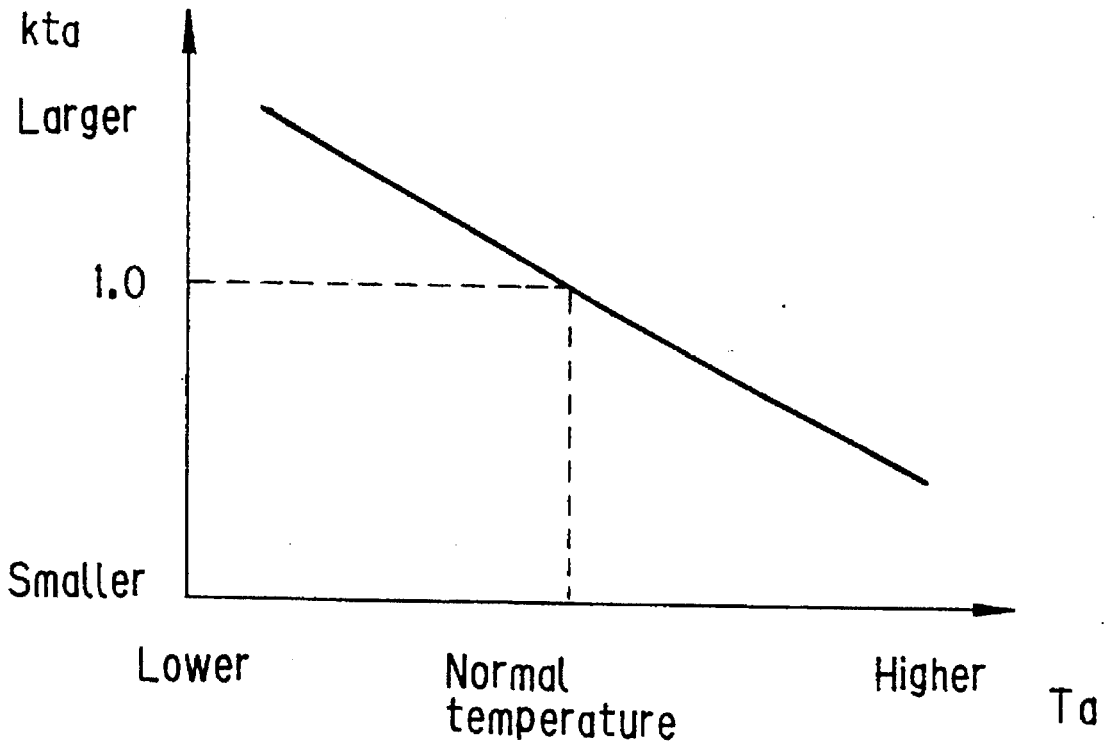
FIG. 16 is a graph showing a characteristic of a coefficient of intake air temperature correction used for correcting the quantity delta Ti.

The program then moves to step S38 in which the retrieved value delta Ti is multiplied by a coefficient kta to conduct the air's temperature correction. This is conducted by retrieving a table, whose characteristic is shown in FIG. 16, by the detected intake air temperature Ta. The reason for this is that the ideal gas law (Equation 6) is used in the calculation. The program then proceeds to step S40 in which the quantity of fuel injection TTH is subtracted by the quantity of correction delta Ti to determine the output quantity of fuel injection Tout, to step S42 in which the fuel injector 22 is driven in response thereto. The value Tout is subject beforehand to battery voltage correction or the like, that is also not the gist of the invention so that no explanation will here be made.

If step S12 finds the engine is being cranked, the program passes to step S44 in which the quantity of fuel injection Ticr at cranking is retrieved from a table (not shown) using the engine coolant water temperature Tw as address datum, to step S46 in which the quantity of fuel injection Tout is determined in accordance with an equation for engine cranking (explanation omitted), while if step S14 finds the fuel cut is in progress, the program goes to step S48 in which the output quantity of fuel injection Tout is set to be zero.

With the arrangement, thus, it becomes possible to entirely describe from the steady-state engine operating condition to the transient engine operating condition by a simple algorithm. It also becomes possible to ensure the quantity of fuel injection under the steady-state engine operating condition to a considerable extent by mapped data retrieval, and the output quantity of fuel injection can therefore be determined optimally without conducting complicated calculations. Further, since the equations are not switched between the steady-state engine operating condition and the transient engine operating condition, and since the equations can describe the entire engine operating conditions, control discontinuity, which would otherwise occur in the proximity of switching if the equations were switched between the steady-state and transient engine operating condition, will not happen. Furthermore, since the behavior of air flow is described properly, the arrangement can enhance the convergence and accuracy of the control.

Figure 23A:
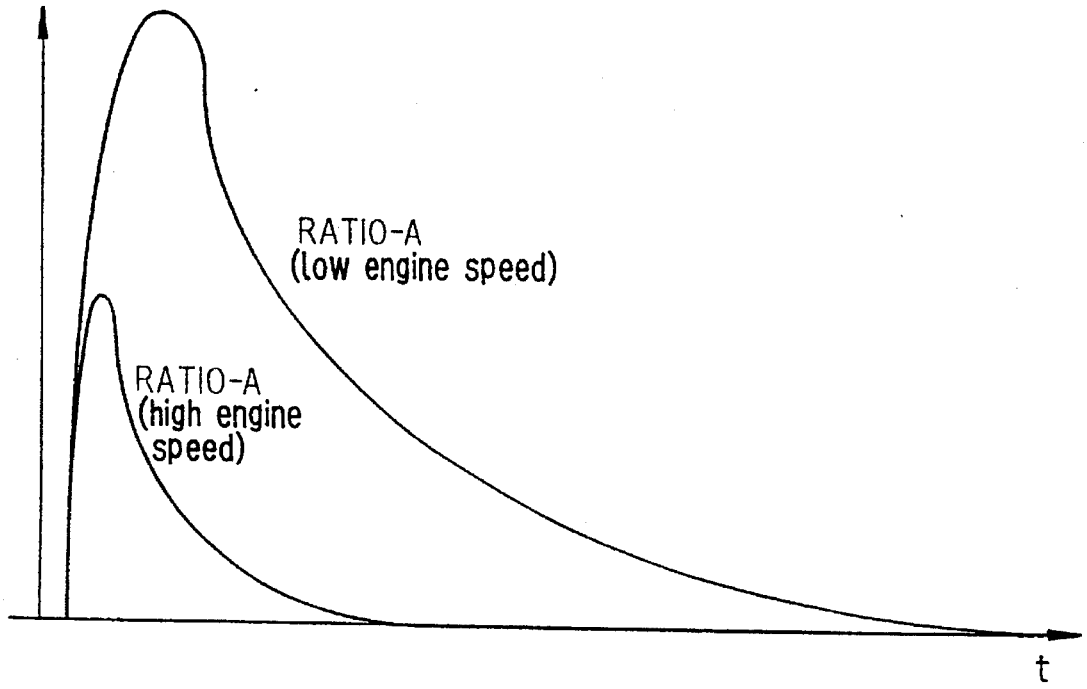
FIGS. 23A and 23B are timing charts showing calculation results influenced by the elongating/shortening of the TDC interval.
Figure 23B:
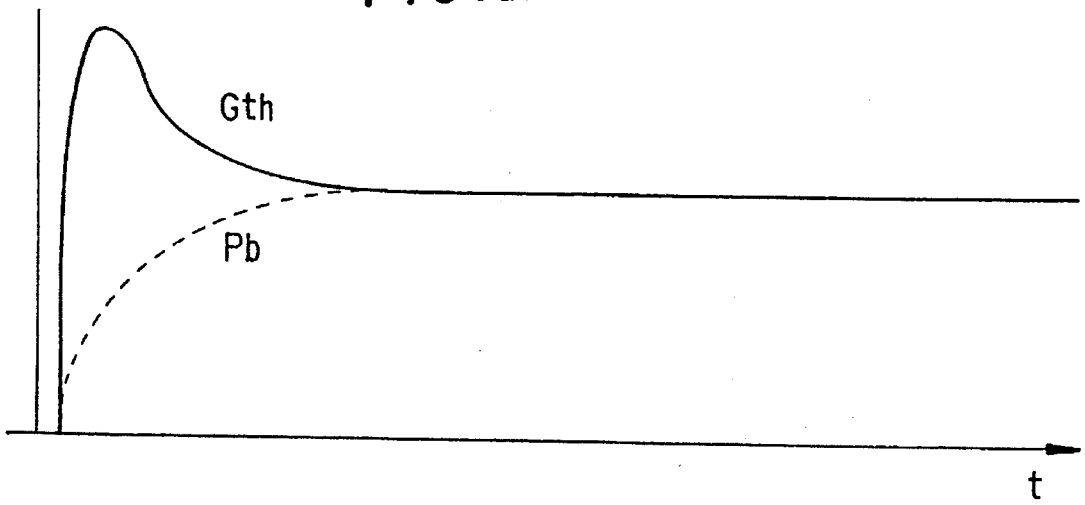

Further, in determining the effective throttle opening area A and its first-order lag value ADELAY to calculate the ratio RATIO-A therebetween, since it is arranged such that the throttle opening's first-order lag value θTH-D at the current control cycle is determined by calculating the weighted average between the value at the last control cycle and the throttle opening at the current control cycle, while varying the weight with the engine speed, the arrangement can solve the disadvantage that the ratio is influenced by increases and decreases of the engine speed as illustrated in FIG. 23A, and it becomes therefore possible to adequately describe the behavior of the quantity of throttle-past air illustrated in the bottom of FIG. 10 and 23B and, enable to accurate determination of the quantity of fuel injection over the entire range of engine operating conditions including the transient engine operating condition.

Figure 19:
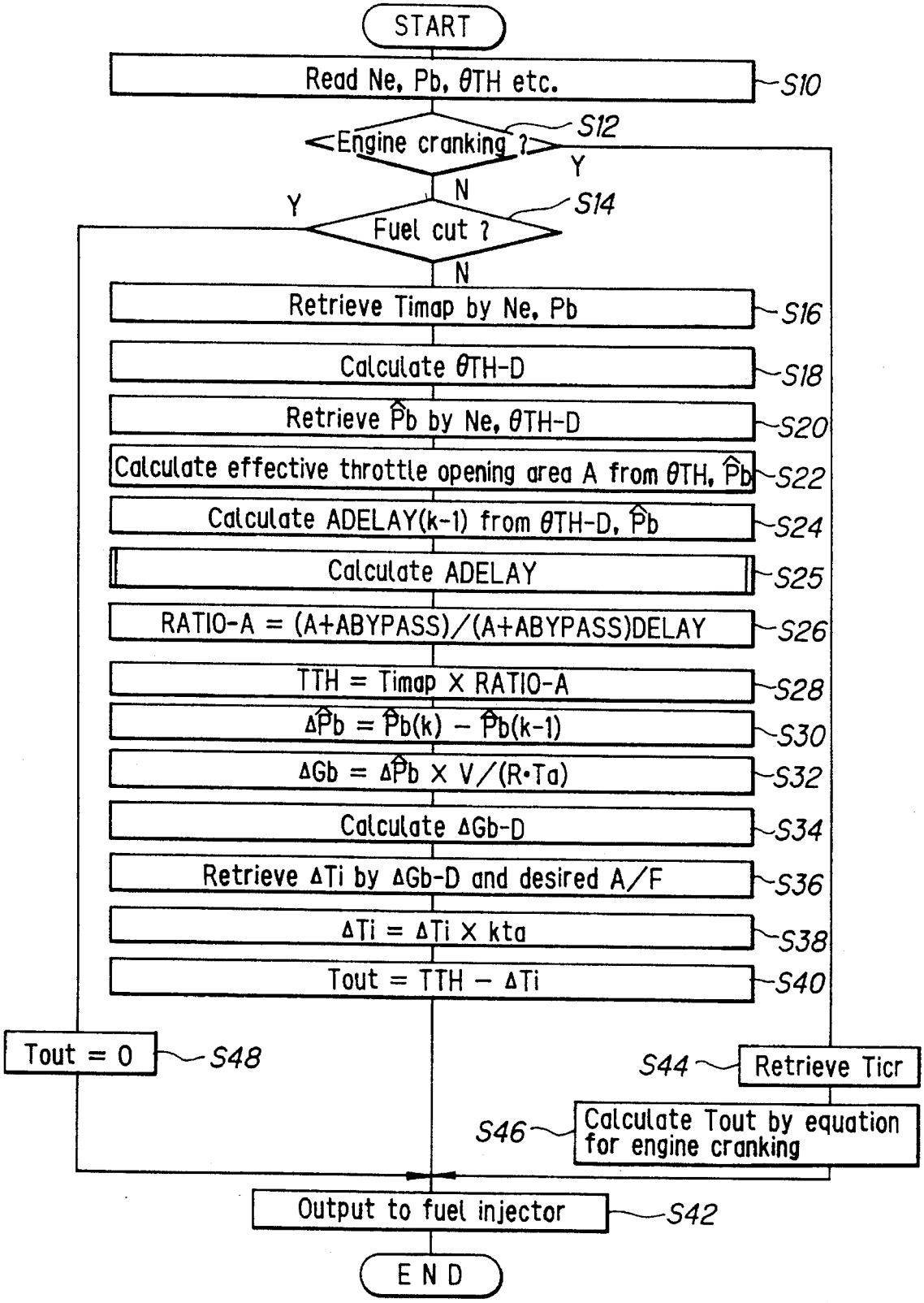
FIG. 19 is a flowchart showing the operation of the system according to the second embodiment of the invention.

FIG. 19 is a flowchart showing the second embodiment of the invention.

Figure 20:
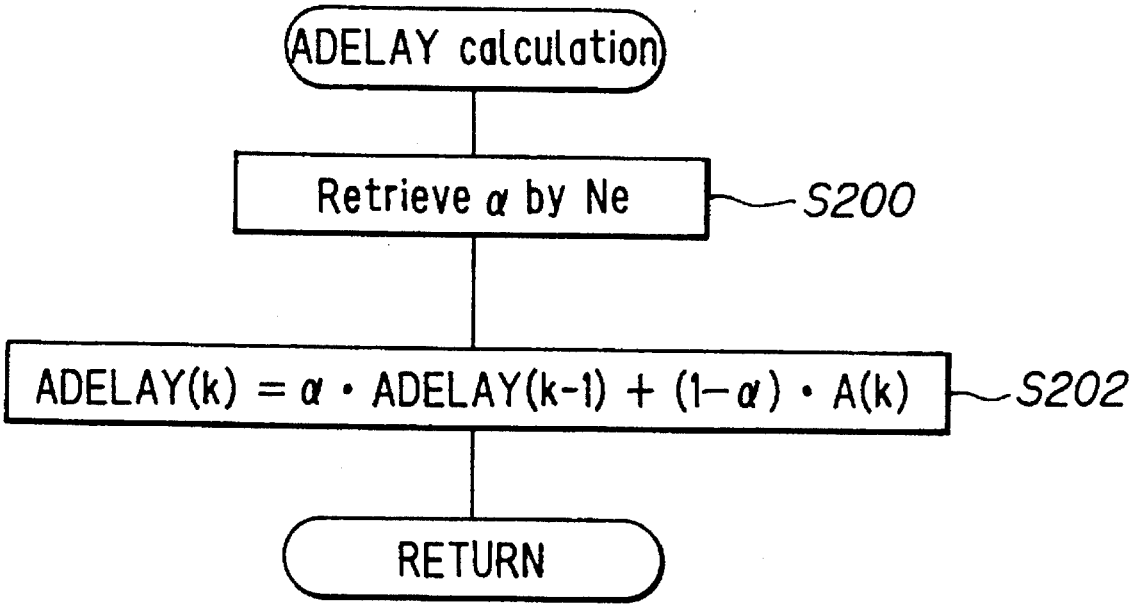
FIG. 20 is a subroutine flowchart of FIG. 19 showing the calculation of the effective throttle opening area's first-order lag value.

In the second embodiment, it is arranged such that a provisional value of pseudo-value ADELAY(k−1) is first determined from θTH-D and P̂b at step S24 and at the next step (S25), the value ADELAY at the current cycle is determined. More specifically, as illustrated in FIG. 20, the weight α is retrieved from the table by the detected engine speed at step S200 and the next step (S202) the effective throttle opening area's first-order lag value ADELAY is calculated as illustrated. In other words, the weight α is determined to decrease such that the contribution of the effective throttle opening area increases as the engine speed decreases. The rest of the configuration as well as the advantages is the same as those of the first embodiment.

Figure 21:
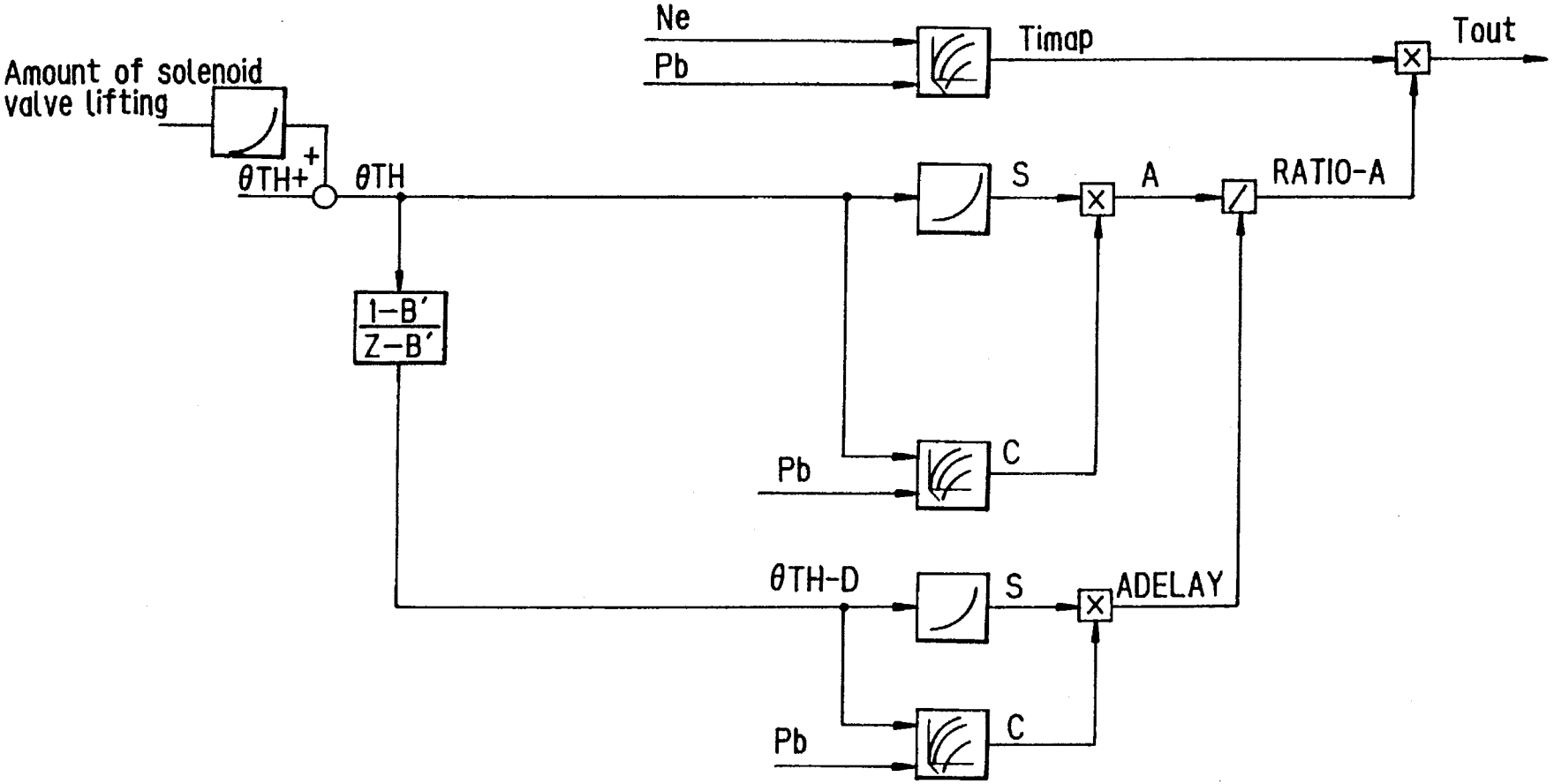
FIG. 21 is a block diagram, similar to FIG. 4, but showing the modification of the configuration shown in FIG. 4.

FIG. 21 is a block diagram showing the modification of the configuration illustrated in FIG. 4.

Specifically, further conducting a search on the system, it has been found that it is unnecessary to determine the quantity of throttle-past air Gth and the quantity of chamber-filling air Gb respectively, and it is possible to calculate the quantity of cylinder-drawn air Gc from the quantity of throttle-past air Gth by calculating the quantity of chamber-filling air Gb from the quantity of throttle-past air Gth. This arrangement can make the configuration simpler and decrease the amount of calculation.

More specifically, in Eq. 6, the quantity of cylinder-drawn air Gc per unit time delta T can be expressed as Eq. 21. This is equivalent to Eqs. 22 and 23 and rewriting of Eqs. 22 and 23 in the form of transfer function yields Eq. 8. In other words, it has been found that the quantity of cylinder-drawn air Gc can be obtained from the first-order lag value of the quantity of throttle-past air Gth. FIG. 21 shows this. Since the transfer function (1−B')/(z−B') is different from that used in FIG. 4, it is appended with the symbol "".

$$Gc(k)=Gth(k)-Gb(k-1) \quad \text{Eq. 21}$$

$$Gc(k)=\alpha\cdot Gth(k)+\beta\cdot Gb(k-1) \quad \text{Eq. 22}$$

$$Gb(k)=(1-\alpha)\cdot Gth(k)+(1-\beta)\cdot Gb(k-1) \quad \text{Eq. 23}$$

$$Gc(z)=\frac{\alpha\cdot z-(\alpha-\beta)}{z-(1-\beta)}\,Gth(z). \quad \text{Eq. 24}$$

Therefore, the output quantity of fuel injection may be determined as:

$$Tout=Timap\times A/ADELAY=Timap\times RATIO\text{-}A$$

It will be apparent from the above that the first and second embodiments will be applied to the configuration shown in FIG. 21. In that case, it suffices that the manifold pressure itself, instead of the pseudo-manifold pressure, is used in the calculations shown, for example, in FIG. 3.

It should be noted that in the foregoing, in determining the first-order lag behavior of the quantity of correction delta Ti, the first-order lag value of the current quantity of chamber-filling air delta Gb is first calculated and the value delta Ti is then calculated therefrom in accordance with the characteristic similar to that shown in FIG. 12. The invention is not limited to the disclosure and it is alternatively possible to obtain the first-order lag value of the pseudo-manifold pressure delta P̂b or the value delta Ti itself.

It should also be noted that although the quantity of correction delta Ti is prepared in advance as mapped data, it is alternatively possible to obtain it by partially or wholly carrying out the calculations.

It should further be noted that although the change of the pseudo-manifold pressure delta P̂b is obtained from the difference between the values obtained at the current and last control cycles, it is alternatively possible to use a value obtained at the control cycle preceding thereto. Further it is alternatively possible to use a differential or a differential integral of the values.

It should further be noted that, although the output quantity of fuel injection Tout is obtained by subtracting the quantity of correction delta Ti corresponding to the quantity of chamber-filling air from the quantity of fuel injection Timap, it is alternatively possible to determine the output quantity of fuel injection Tout immediately from the quantity of fuel injection Timap, when the engine has only one cylinder with a chamber volume small enough to be neglected.

It should further be noted that, although the effective throttle opening area's first-order lag value is determined using the throttle opening's first-order lag value, it is alternatively possible to obtain the effective throttle opening area's first-order lag value itself.

It should further be noted that, although the quantity of fuel injection Timap is prepared in advance as mapped data, it is alternatively possible to prepare, instead of the value Timap, the quantity of throttle-past air Gth as mapped data. Although the alternative will be disadvantageous in that it could not absorb the change in the quantity of air drawn in the cylinder due to pulsation or an error resulting when the fuel injector's characteristic is not linear, it will nevertheless be possible to attain the object of the invention to some extent.

It should further be noted that, although the first-order lag value is used for ADELAY, θTH-D, it is alternatively possible to use the second-order or more lag value.

While the invention has thus been shown and described with reference to the specific embodiments. However, it should be noted that the invention is in no way limited to the details of the described arrangements, changes and modifications may be made without departing from the scope of the appended claims.

What is claimed is:

1. A system for controlling fuel metering in an internal combustion engine, including:

engine operating condition detecting means for detecting parameters indicating an engine operating condition at least including an engine speed (Ne), a manifold pressure (Pb) and a throttle valve opening (θTH);

fuel injection quantity obtaining means for obtaining a quantity of fuel injection (Timap) in accordance with a predetermined characteristic at least based on the engine speed (Ne) and the manifold pressure (Pb);

first effective throttle opening area determining means for determining an effective throttle opening area (A) at least based on the throttle valve opening (θTH) and the manifold pressure (Pb);

second effective throttle opening area determining means for determining a value (ADELAY) indicative of an n-th order lag of the effective throttle opening area (A); and fuel injection quantity determining means for determining a quantity of fuel injection (Tout) by multiplying the quantity of fuel injection (Timap) by a ratio between the effective throttle opening area (A) and the value (ADELAY) as $$Tout=Timap\times A/ADELAY$$

wherein the improvement comprises:

said second effective throttle opening area determining means determines the value (ADELAY) using a time constant that varies with the engine speed (Ne).

2. A system according to claim 1, wherein said second effective throttle opening area determining means includes;

n-th order lag value determining means for determine a value (θTH-D) indicative of an n-th order lag of value of the throttle valve opening (θTH) using a time constant (α) that varies with the engine speed (Ne); and ADELAY calculating means for calculating the value (ADELAY) at least based on the value (θTH-D).

3. A system according to claim 2, wherein said n-th order lag value determining means determines the value (θTH-D) by calculating a weighted average between the value (θTH-D) and the throttle valve opening (θTH) using a weight (α) that varies with the engine speed (Ne).

4. A system according to claim 3, wherein said n-th order lag value determining means decreases the weight (α) as the engine speed decreases such that contribution of the throttle opening (θTH) increases as the engine speed (Ne) decreases.

5. A system according to claim 2, wherein said ADELAY calculating means calculates the value ADELAY based on the value (θTH-D) and the manifold pressure (Pb).

6. A system according to claim 5, wherein the manifold pressure (Pb) is a pseudo-manifold pressure obtained from the n-th order lag value (θTH-D) and the engine speed.

7. A system according to claim 3, wherein said ADELAY calculating means calculates the value ADELAY based on the value (θTH-D) and the manifold pressure (Pb).

8. A system according to claim 7, wherein the manifold pressure (Pb) is a pseudo-manifold pressure obtained from the n-th order lag value (θTH-D) and the engine speed.

9. A system according to claim 4, wherein said ADELAY calculating means calculates the value ADELAY based on the value (θTH-D) and the manifold pressure (Pb).

10. A system according to claim 9, wherein the manifold pressure (Pb) is a pseudo-manifold pressure obtained from the n-th order lag value (θTH-D) and the engine speed.

11. A system according to claim 2, wherein said n-th order lag value determining means includes:

comparing means for comparing the throttle valve opening (θTH) with a marginal limit (θTHW); and replacing means for replacing the throttle valve opening (θTH) with the marginal limit (θTHW) when the throttle valve opening (θTH) is not less than the marginal limit (θTHW).

12. A system according to claim 1, wherein said second effective throttle opening area determining means determines the value (ADELAY) using a time constant (α) that varies with the engine speed (Ne).

13. A system according to claim 12, wherein said second effective throttle opening area determining means determines the value (ADELAY) by calculating a weighted average between the value (ADELAY) and the effective throttle opening area (A) using a weight (α) that varies with the engine speed (Ne).

14. A system according to claim 13, wherein said second effective throttle opening area determining means decreases the weight (α) as the engine speed decreases such that contribution of the effective throttle opening area (A) increases as the engine speed (Ne) decreases.

* * * * *